US008876322B2

(12) United States Patent
Alexander

(10) Patent No.: US 8,876,322 B2
(45) Date of Patent: Nov. 4, 2014

(54) LINEAR LED MODULE AND SOCKET FOR SAME

(71) Applicant: Journée Lighting, Inc., Westlake Village, CA (US)

(72) Inventor: Clayton Alexander, Westlake Village, CA (US)

(73) Assignee: Journée Lighting, Inc., Westlake Village, CA (US)

( * ) Notice: Subject to any disclaimer, the term of this patent is extended or adjusted under 35 U.S.C. 154(b) by 0 days.

(21) Appl. No.: 13/867,730

(22) Filed: Apr. 22, 2013

(65) Prior Publication Data

US 2013/0343037 A1 Dec. 26, 2013

Related U.S. Application Data

(60) Provisional application No. 61/662,012, filed on Jun. 20, 2012.

(51) Int. Cl.
*F21V 29/00* (2006.01)
*F21V 19/00* (2006.01)

(52) U.S. Cl.
CPC ..... *F21V 19/0015* (2013.01)
USPC ..... 362/217.12; 362/218; 362/95

(58) Field of Classification Search
USPC ..... 362/218, 217.11, 217.12, 217.13, 362/217.15, 217.16, 652, 655, 294, 95; 439/851
See application file for complete search history.

(56) References Cited

U.S. PATENT DOCUMENTS

| | | | |
|---|---|---|---|
| 4,445,164 | A | 4/1984 | Giles, III et al. |
| 4,580,859 | A | 4/1986 | Frano et al. |
| 4,727,648 | A | 3/1988 | Savage, Jr. |
| 4,837,927 | A | 6/1989 | Savage, Jr. |
| 5,087,212 | A | 2/1992 | Hanami |
| 5,174,649 | A | 12/1992 | Alston |
| 5,387,901 | A | 2/1995 | Hardt |
| 5,436,809 | A | 7/1995 | Brassier et al. |
| 5,490,048 | A | 2/1996 | Brassier et al. |
| 5,632,551 | A | 5/1997 | Roney et al. |
| 6,426,704 | B1 | 7/2002 | Hutchison |
| 6,439,743 | B1 | 8/2002 | Hutchison |
| 6,450,662 | B1 | 9/2002 | Hutchison |
| 6,473,002 | B1 | 10/2002 | Hutchison |
| 6,474,839 | B1 | 11/2002 | Hutchison |

(Continued)

FOREIGN PATENT DOCUMENTS

| | | |
|---|---|---|
| CA | 2 623 604 | 8/2009 |
| CN | 201739849 | 2/2011 |

(Continued)

OTHER PUBLICATIONS

International Search Report and Written Opinion mailed on Nov. 27, 2013 in PCT Application No. PCT/US2013/045708.

*Primary Examiner* — Karabi Guharay
(74) *Attorney, Agent, or Firm* — Knobbe Martens Olson & Bear, LLP

(57) ABSTRACT

A lighting assembly can include a linear light module with one or more LED light elements, where a length of the light module is greater than a width of the light module. An elongate socket removably receives the linear light module therein. The socket includes a locking mechanism actuatable to releasably and resiliently lock the linear light module in the socket via actuation of one or more levers.

13 Claims, 41 Drawing Sheets

(56) References Cited

U.S. PATENT DOCUMENTS

| | | | | |
|---|---|---|---|---|
| 6,527,422 | B1 | 3/2003 | Hutchison | |
| 6,773,138 | B2 | 8/2004 | Coushaine | |
| 6,824,296 | B2 | 11/2004 | Souza et al. | |
| 6,827,469 | B2 | 12/2004 | Coushaine et al. | |
| 7,093,958 | B2 | 8/2006 | Coushaine | |
| 7,150,553 | B2 | 12/2006 | English et al. | |
| 7,360,925 | B2 | 4/2008 | Coushaine | |
| 7,540,761 | B2 | 6/2009 | Weber et al. | |
| 7,549,786 | B2 | 6/2009 | Higley et al. | |
| 7,575,332 | B2 | 8/2009 | Cok | |
| 7,604,365 | B2 | 10/2009 | Chang | |
| 7,703,951 | B2 | 4/2010 | Piepgras et al. | |
| 7,727,009 | B2 | 6/2010 | Goto | |
| 7,731,396 | B2 | 6/2010 | Fay et al. | |
| 7,744,266 | B2 | 6/2010 | Higley et al. | |
| 7,766,518 | B2 | 8/2010 | Piepgras et al. | |
| 7,806,562 | B2 | 10/2010 | Behr et al. | |
| 7,841,753 | B2 | 11/2010 | Liu | |
| 7,922,364 | B2 | 4/2011 | Tessnow et al. | |
| 7,923,907 | B2 | 4/2011 | Tessnow et al. | |
| 7,952,114 | B2 | 5/2011 | Gingrich, III | |
| 7,972,038 | B2 | 7/2011 | Albright et al. | |
| 7,988,336 | B1 * | 8/2011 | Harbers et al. | 362/294 |
| 8,033,680 | B2 | 10/2011 | Sharrah et al. | |
| 8,052,310 | B2 | 11/2011 | Gingrinch, III et al. | |
| 8,154,864 | B1 | 4/2012 | Nearman et al. | |
| 8,172,436 | B2 | 5/2012 | Coleman et al. | |
| 2002/0117692 | A1 | 8/2002 | Lin | |
| 2003/0058658 | A1 | 3/2003 | Lee | |
| 2003/0072156 | A1 | 4/2003 | Pohlert et al. | |
| 2006/0141851 | A1 | 6/2006 | Matsui et al. | |
| 2007/0064428 | A1 | 3/2007 | Beauchamp | |
| 2010/0246179 | A1 | 9/2010 | Long et al. | |
| 2011/0122643 | A1 | 5/2011 | Spork et al. | |
| 2011/0134634 | A1 | 6/2011 | Gingrich, III et al. | |
| 2011/0136374 | A1 | 6/2011 | Mostoller et al. | |
| 2011/0222270 | A1 | 9/2011 | Porciatti | |
| 2011/0255287 | A1 | 10/2011 | Li | |
| 2012/0002417 | A1 | 1/2012 | Li | |
| 2012/0051048 | A1 | 3/2012 | Smit et al. | |
| 2012/0051056 | A1 | 3/2012 | Derks et al. | |
| 2012/0051068 | A1 | 3/2012 | Pelton et al. | |
| 2012/0106152 | A1 | 5/2012 | Zheng et al. | |

FOREIGN PATENT DOCUMENTS

| | | |
|---|---|---|
| CN | 202040752 | 11/2011 |
| CN | 102269351 | 12/2011 |
| GB | 2457016 | 8/2009 |
| JP | 2011508406 | 3/2011 |
| JP | 2011204495 | 10/2011 |
| JP | 2011204658 | 10/2011 |
| KR | 20090013704 | 2/2009 |
| WO | WO 02/15281 | 2/2002 |

* cited by examiner

LINEAR LED MODULE AND SOCKET FOR SAME

CROSS-REFERENCE TO RELATED APPLICATIONS

This application claims the benefit of U.S. Provisional Application No. 61/662,012 filed on Jun. 20, 2012, entitled LINEAR LED MODULE AND SOCKET FOR SAME, the entire contents of which are incorporated by reference and should be considered a part of this specification.

BACKGROUND

1. Field

The present invention is directed to LED light modules, and more particularly to a linear LED light module and a socket for resiliently receiving the same.

2. Description of the Related Art

Several LED light modules have been developed recently to satisfy the growing interest in LED lighting solutions. Many such modules have the LED chips bolted down, glued down or attached directly to an accompanying heat sink. There is no easy way to remove and replace the LED lighting element from the heat sink or heat dissipating housing of a light fixture. One of the contributors to the relative higher cost of some LED light modules can be the cost of manufacturing the heat sink and module together as one unit. Additionally, the linear LED modules that use fasteners (e.g. screws) to bolt the module down to the heat sink cannot be easily replaced or upgraded.

SUMMARY

There is a need for a linear LED light module that can be easily detached from its heat sink, with no tools, as well as provide for effective dissipation of the heat generated by the LED light module.

One objective of the present invention is to provide a linear LED light module that is easy to install in a socket, thereby simplifying its replaceability. Another objective of the invention is to provide a linear LED light module that can resiliently couple to a corresponding socket so that the module contacts a heat dissipating member (e.g. heat sink, active cooling system, heat dissipating portion of the light fixture, etc.) to thereby dissipate heat generated by the LED light module to the heat dissipating member. Another objective is to provide a linear LED light module and corresponding socket that can be manufactured at a lower cost, as the resilient connection between the light module and socket can allow for larger manufacturing tolerances.

Also, a light fixture manufacturer can reduce its inventory liability because the light fixture manufacturer will not need to stock light fixtures with every variety of color temperature (e.g. 2700 k, 3000 k, 3500 k and 4000 k), beam angle (e.g. 10 degree, 25 degree, 36 degree, etc.) and CRI option (e.g. 80 CRI and 90 CRI). Embodiments disclosed herein will allow for a light fixture manufacturer to stock only the light fixture, which will have a built-in socket, and can stock the linear LED light module independently, or buy from another supplier on an order by order basis. This will greatly reduce the amount of inventory that a light fixture manufacturer needs to hold. Another objective is to allow the end-user of the light fixture the ability to change out the linear LED light module in the field (with no tools) if the user decides to try a different beam angle, color temperature, CRI or other option. The linear LED module can also be changed out like a standard light bulb, if it should fail, or when the lumen output falls below an acceptable level.

In accordance with one embodiment, a lighting assembly is provided comprising a linear light module having one or more LED light elements, a socket configured to removably receive the linear light module therein, and a resilient mechanism (e.g., spring loaded mechanism) configured to releasably and resiliently couple the linear light module to the socket.

In accordance with another embodiment a lighting assembly is provided. The lighting assembly comprises a linear light module comprising one or more LED light elements, a length of the light module being greater than a width of the light module. The lighting assembly also comprises an elongate socket configured to removably receive the linear light module therein, the socket comprising a locking mechanism actuatable to releasably and resiliently lock the linear light module in the socket via actuation of one or more levers by a user.

In accordance with another embodiment, a lighting assembly is provided. The lighting assembly comprises a linear light module comprising one or more LED light elements, a length of the light module being greater than a width of the light module. The lighting assembly further comprises an elongated socket configured to removably receive the linear light module therein, and means for releasably locking the linear light module in the socket via actuation of one or more levers by a user.

In accordance with another embodiment, a linear light module is provided. The linear light module comprises a generally elongate body with a length of the body greater than a width of the body, one or more light elements, one or more pins extending from at least one side of the body, the pins configured for insertion in openings in a top surface of a socket configured to receive the body, and an electrical contact member configured to contact an electrical contact element in the socket.

In accordance with still another embodiment, an elongate socket for releasably receiving a linear light module is provided. The socket comprises an electrical contact member configured to releasably contact an electrical contact member on the linear light module. The socket further comprises one or more engagement members configured to releasably engage with one or more portions of the linear light module. The socket further comprises a manually actuatable release member actuatable by a user to disengage the one or more engagement members from the one or more portions of the linear light module, thereby allowing withdrawal of the linear light module from the socket.

BRIEF DESCRIPTION OF THE DRAWINGS

FIG. 21 is a top planar view of another embodiment of a linear light module.

DETAILED DESCRIPTION

Described herein are various embodiments of a linear or elongate light module and a socket for releasably receiving the linear light module. In some embodiments, the linear light module can be a linear LED light module. In some embodiments, the linear light module can be generally rectangular (e.g., with its length being greater than its width). In other embodiments, the linear light module can have other shapes.

Figure 1:
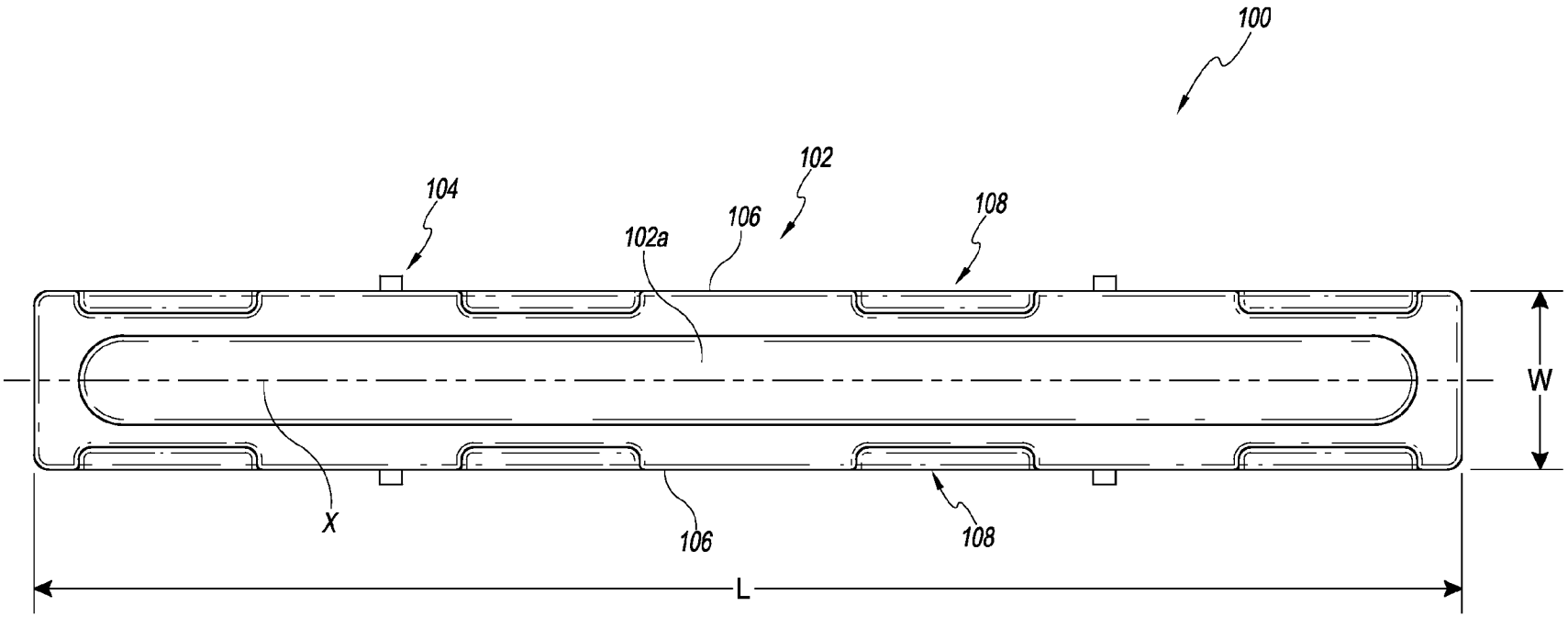
FIG. 1 is a top planar view of one embodiment of a linear light module.
Figure 2:
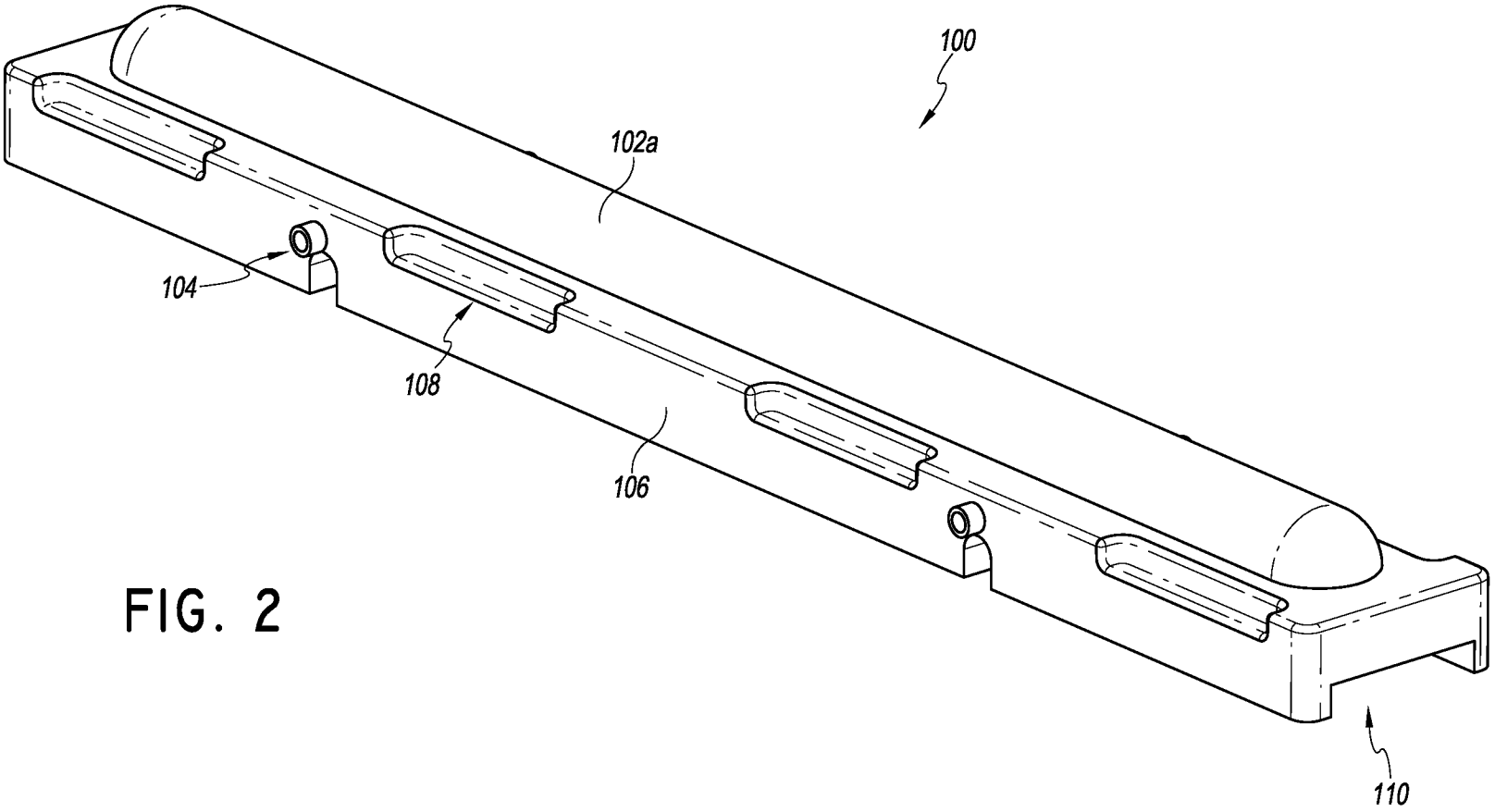
FIG. 2 is a top perspective view of the linear light module of FIG. 1.
Figure 3:
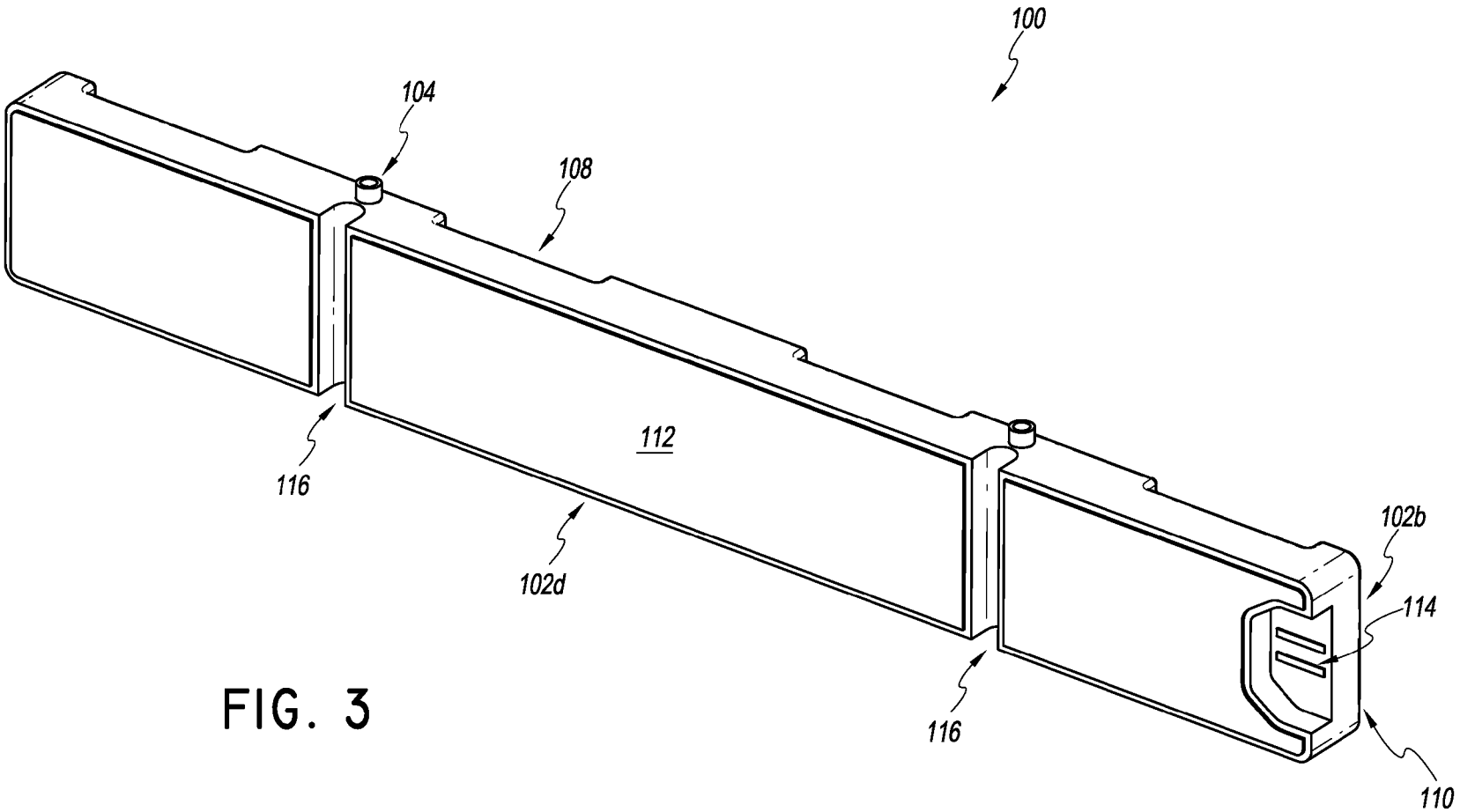
FIG. 3 is a bottom perspective view of the linear light module of FIG. 1

FIGS. 1-3 show one embodiment of a linear light module 100. The linear light module 100 can have one or more LED light elements (not shown) (e.g., spaced apart along a length L of the linear light module). As shown in FIGS. 1-2, the linear LED light module 100 can have one or more pins 104 that extend from a side 106 of the module body 102. In the illustrated embodiment, the module body 102 has a plurality of pins 104 that extend from opposite sides 106 of the body 102. Optionally, the light module body 102 can also have one or more recesses 108 on a top surface 102*a* thereof to aid in gripping or holding the light module 102 during the installation process. In the illustrated embodiment, the light module body 102 has a plurality of recesses 108 on opposite sides 106 of the body 102.

With reference to FIG. 3, the linear LED light module 100 can have a recess 110 at one end 102*b* thereof that extends from a bottom surface 112 of the module. An electrical contact element 114 of the linear light module 100 can be disposed in the recess 110 and can be electrically connected to the one or more LED light elements or to an internal LED driver circuit or surge protection circuit or other circuitry within the light module 100. The electrical contact element 114 can contact a corresponding electrical contact member on the socket, as discussed further below. Additionally, the linear LED light module 100 can have one or more slots, recesses or openings 116 formed in the bottom 102*d* of the module body 102 that extend generally transverse to the longitudinal axis X of the module body 102. As shown in FIG. 3, the one or more transverse openings 116 preferably align with the one or more pins 104. The bottom surface 112, or a portion of the bottom surface 112, of the linear LED light module 100 can be a thermally conductive surface such that heat generated by the one or more LED lighting elements can be transferred to the thermally conductive bottom surface 112 of the module body 102, through which heat can be transferred to the heat dissipating member, as discussed below.

Figure 4:
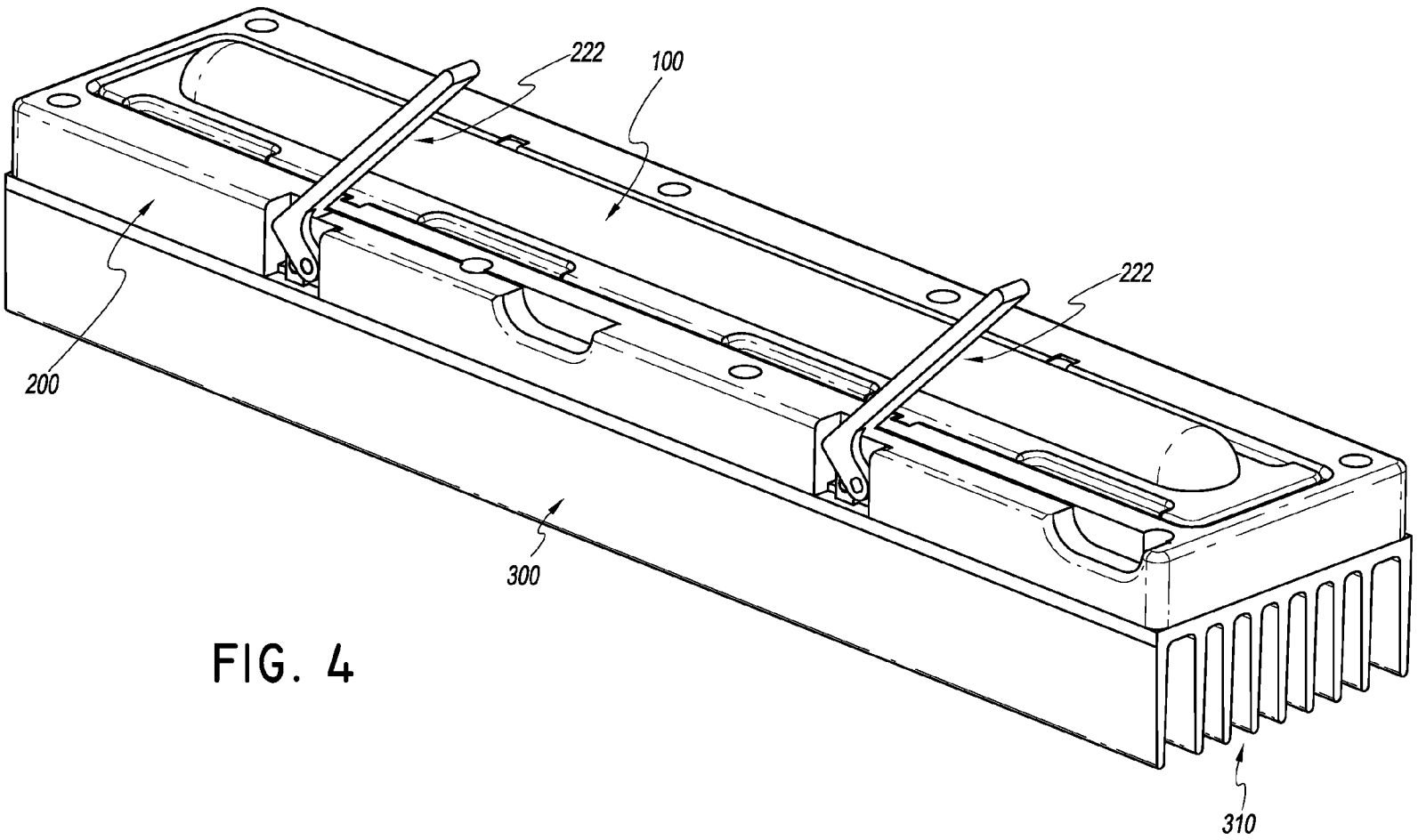
FIG. 4 is a top perspective view of the linear light module of FIG. 1 installed in a corresponding socket attached to a heat dissipating member, with the locking mechanism in an open position.
Figure 5:
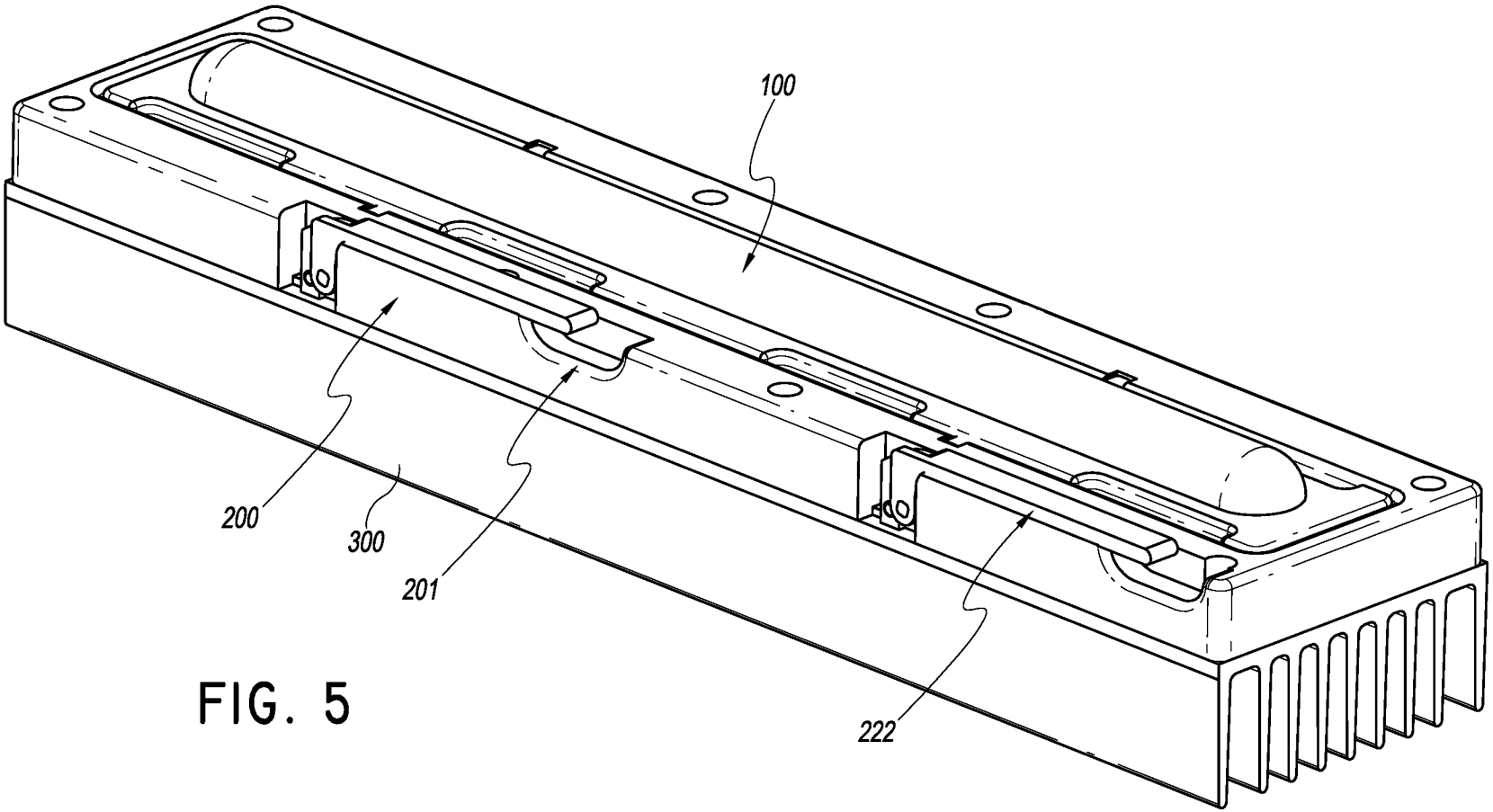
FIG. 5 is a top perspective view of the linear light module of FIG. 1 installed in a corresponding socket attached to a heat dissipating member, with the locking mechanism in a closed position.

FIG. 4 shows the linear LED light module 100 coupled to a corresponding socket 200, where the socket 200 is attached to a heat dissipating member 300. The socket 200 can include a locking mechanism 220 (see FIG. 6), which can have one or more levers 222 that can be actuated by a user to move the locking mechanism 220 between an unlocked (e.g., open) position and a locked (e.g., closed) position. In the illustrated embodiment, the locking mechanism levers 222 of the socket 200 are in an intermediate position (e.g., at 45°). FIG. 5 shows the locking mechanism levers 222 in the closed position, which fixedly locks the light module 100 to the socket 200. When coupled in this manner, the thermal interface bottom surface 112 of the light module 100 resiliently contacts at least a portion of the heat dissipating member 300, thereby transferring heat generated by the LED lighting element(s) to the heat dissipating member 300. The heat dissipating member 300 can have one or more fins 310 to facilitate the dissipation of heat to the environment (e.g., via convection heat transfer). The socket 200 can have a recess 201 to allow the user to access at least a portion of the lever 222 when in the closed position, to engage the lever 222 (e.g., with the user's finger(s)) to move the lever 222 to the open or unlocked position for removing the linear light module 100 from the socket 200.

Figure 6:
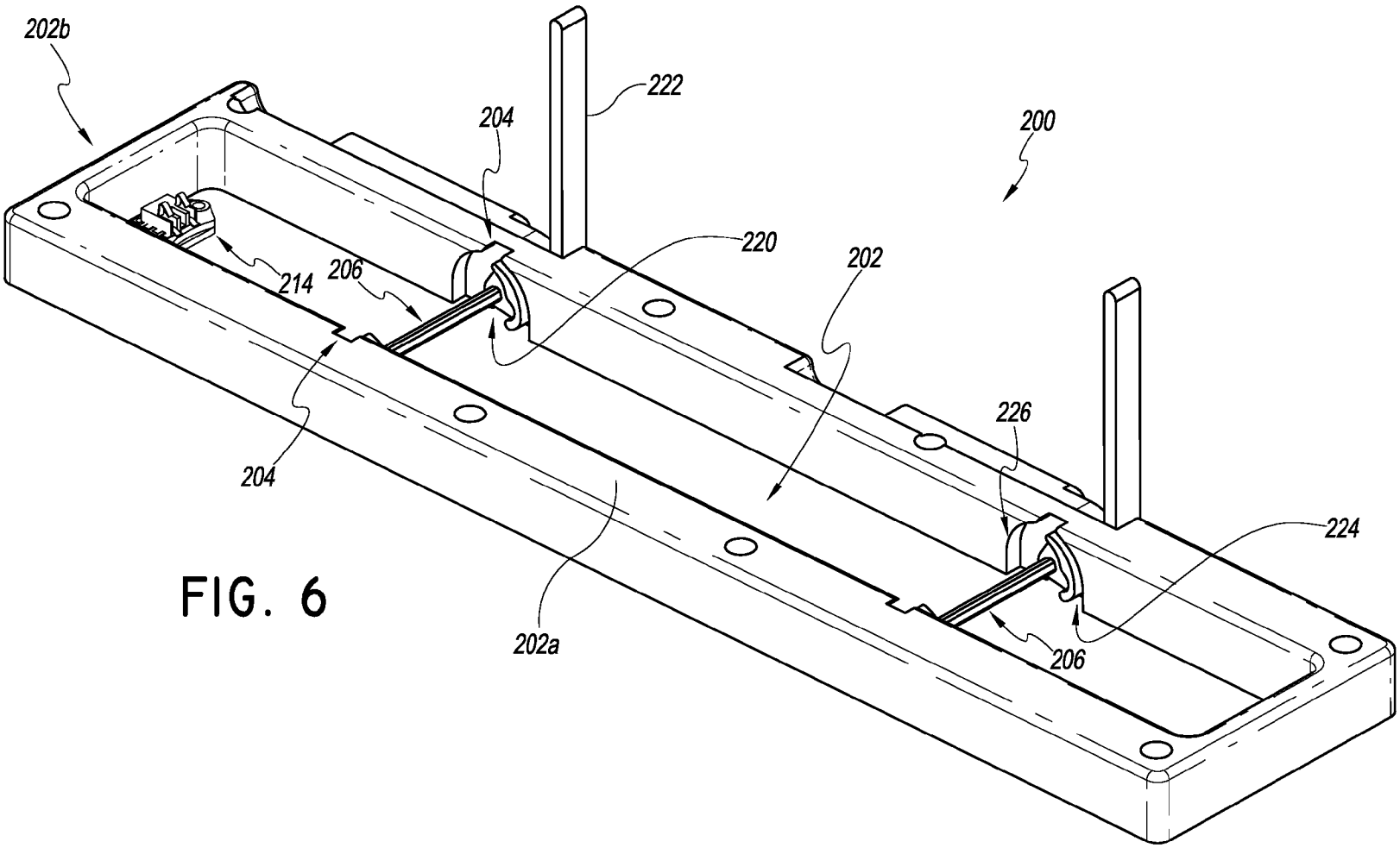
FIG. 6 is a top perspective view of the socket of FIG. 4 detached from the heat dissipating member with the locking mechanism in a fully open position.
Figure 7:
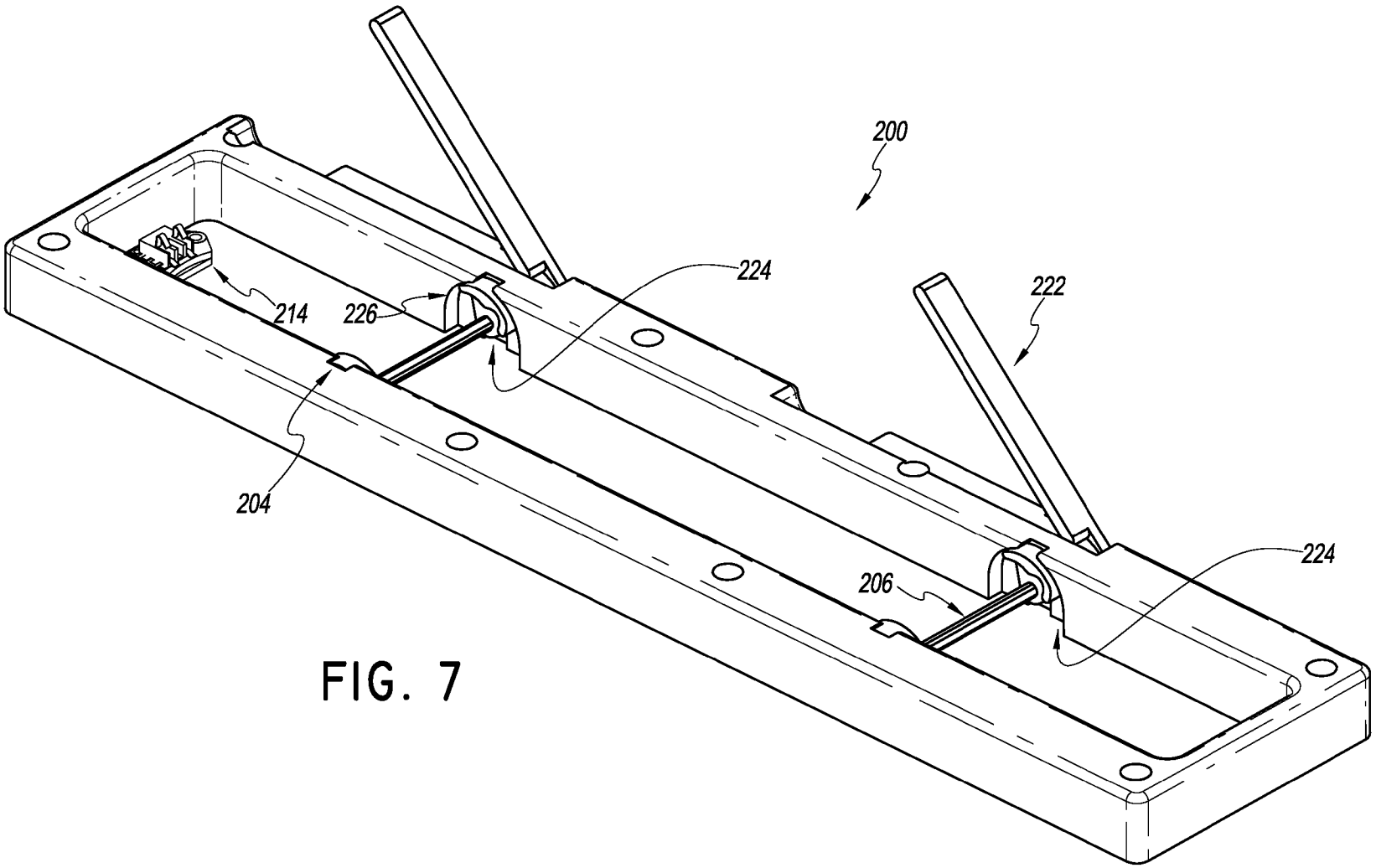
FIG. 7 is a top perspective view of the socket of FIG. 4 detached from the heat dissipating member, with the locking mechanism in an open position.
Figure 8:
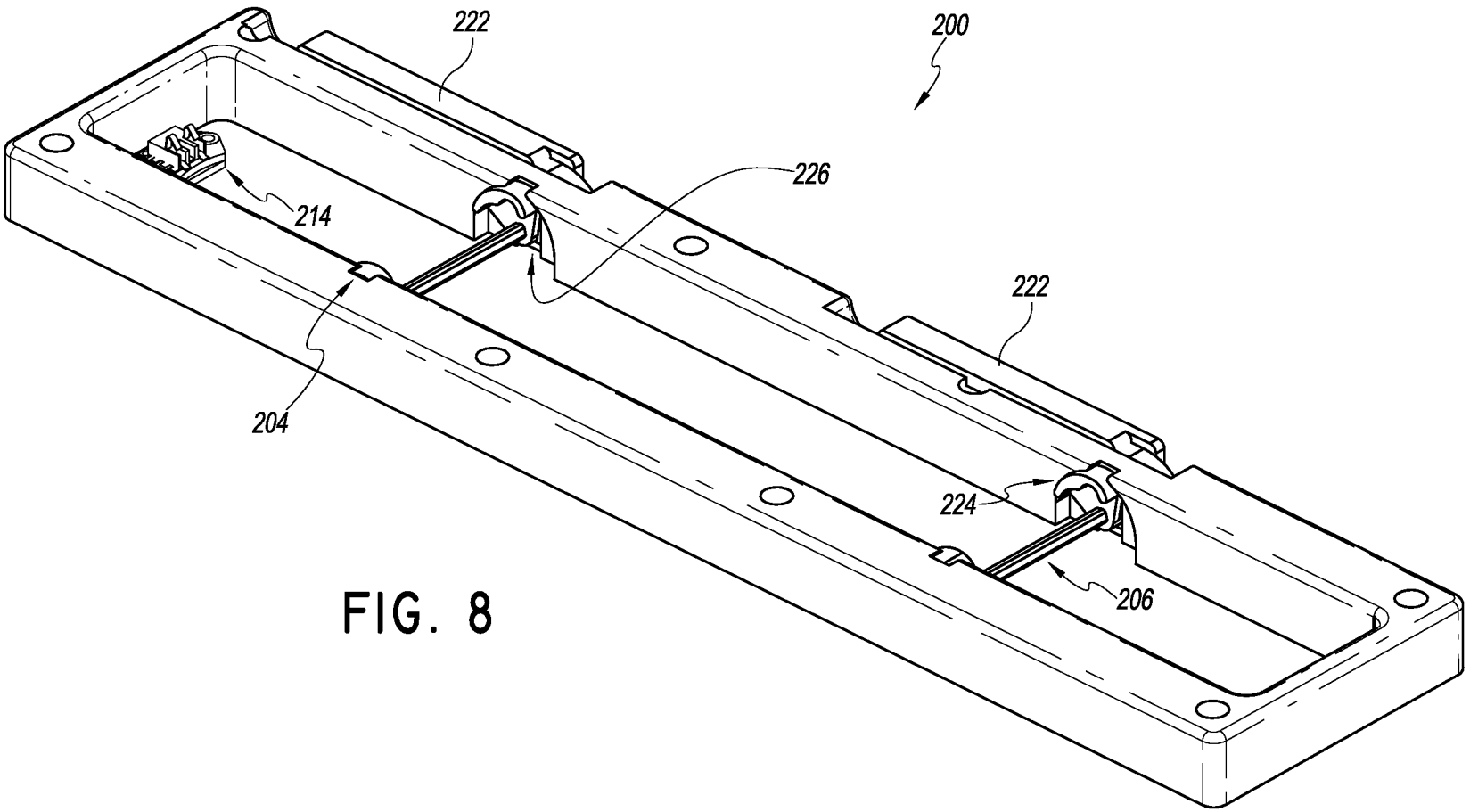
FIG. 8 is a top perspective view of the socket of FIG. 4 detached from the heat dissipating member, with the locking mechanism in a closed position.

FIGS. 6-8 show the socket 200 unattached to the heat dissipating member 300. The socket 200 has an opening 202 into which the linear LED light module 100 can be inserted. The socket 200 can also have an electrical contact member 214 at one end 202*b* that can contact the electrical contact element 114 on the light module 100 when the light module 100 is installed in the socket 200 to thereby provide an electrical connection between the light module 100 and the socket 200.

The socket 200 has one or more pin slots or openings 204 on an upper surface 202*a* thereof which can be sized to receive the one or more pins 104 on the light module body 102. Additionally, the socket 202 has one or more axles 206 operatively coupled to the locking mechanism levers 222. Each of the axles 206 interconnects a lock 224 of the locking mechanism 220 on either side of the socket 200. In the illustrated embodiment, the socket 200 has four locks 224, each rotatable within its locking chamber 226, two of which are hidden from view in FIGS. 6-8. Rotation of the lever 222 of the locking mechanism 220 rotates the locks 224 closest to the lever 222, as well as rotates the corresponding axle 206, which in turn rotates the lock 224 on the other end of the axle 206. In FIG. 6, the locking mechanism levers 222 are shown in the open position (e.g., the locking mechanism 220 is in an unlocked position). In such a position, the light module 100 can be inserted into the socket 200 (e.g., inserted into the opening 202 of the socket 200) so that the pins 104 travel through the pin slots or openings 204 into the locking chamber 226, and so that the axles 206 extend into the transverse slots, recesses or openings 116 on the bottom 102*d* of the light module body 102. In another embodiment (not shown) the one or more axles 206 can be disposed at one or both of the ends of the socket 200, and the recesses 116 in the module body 102 can be excluded. FIG. 7 shows the locking mechanism levers at 45°, in an intermediate position, where the lock 224 is beginning to engage the pins 104 of the light module 100. As can be seen in FIG. 7, with the levers 222 in this position, the pin slots or openings 204 are blocked by a portion of the lock 224, so that a user could not insert the light module 100 into the socket 200, or remove the light module 100 from the socket 200, if the levers where at 45°. FIG. 8 shows the locking mechanism levers 222 in the closed position, where the socket 200 holds the light module 100 in a fixed or locked position, as further discussed below.

Figure 9:
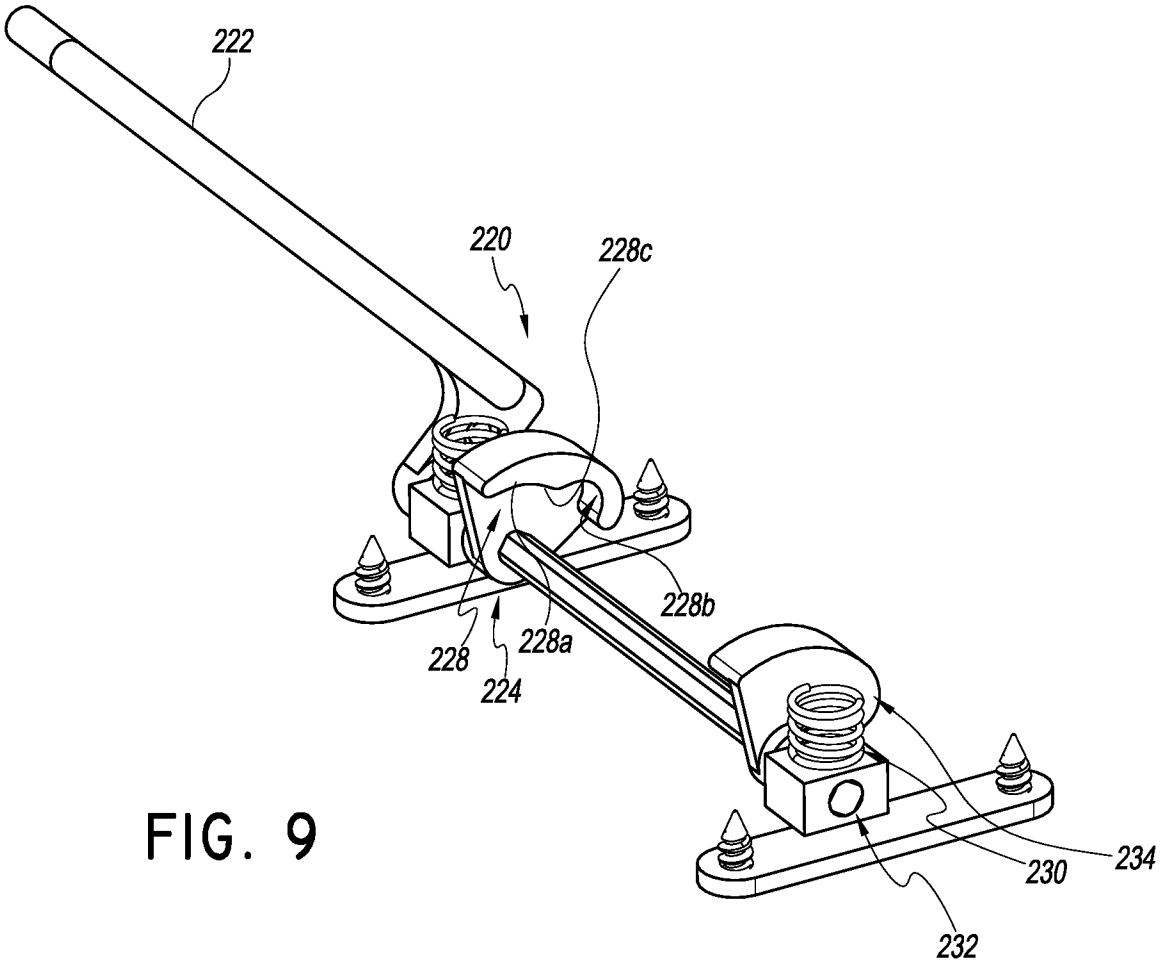
FIG. 9 is a partial cross-sectional view showing the locking mechanism of the socket of FIG. 4, with the body of the socket shown in phantom to illustrate the locking mechanism.

FIG. 9 shows one embodiment of the locking mechanism 220. As can be seen, the lock 224 has a ramp surface 228 on which the corresponding pin 104 of the light module body 102 rides, slides or moves as the lever 222 is rotated from an open position to the closed position. The ramp surface 228 has an inclined portion 228*a* that extends to a curved locking recess 228*b*. As the lever 222 is rotated by a user with the LED light module 100 in the socket 200, the pin rides, slides or otherwise moves on the ramp surface 228 until it reaches an apex 208*c* between the inclined portion 228*a* and the locking recess 228*b*. One or more springs 230 disposed between an axle block 232 on which the axle 206 turns and a recess 234 of the socket 200 exert a force on the axle 206, and thereby the pin 104, and thereby the light module body 102, to press the light module body 102 against a surface of the heat dissipating member 300. As the user continues to rotate the lever 222, the pin 104 moves over the apex 228*c* and into the locking recess 228*b*, which holds the pin 104, and thereby the light module 100, in the locked position. In the illustrated embodiment, as the two locks 224 are attached to the axle 206 and rotate with the axle 206, the locks 224 on both sides of the socket 200 will engage the pins 104 on both sides of the light module body 102 in generally the same manner.

In the illustrated embodiment, the springs 230 are disposed in the socket 200 between the axle block 232 and a surface of the socket 200. However, in another embodiment, the springs can be in the linear LED light module 100. For example, the pins 104 on the light module body 102 could be spring loaded. In still another embodiment, thermal pad(s) on the bottom 102*b* of the module 100 could be spring-loaded. In still another embodiment, the springs could be elsewhere between the socket and the light module body.

In the illustrated embodiment, there is a lock 224 on both sides of the socket 200, operatively connected by an axle 206. However, in another embodiment the module can hook in on one side of the socket and have at least one lock mechanism on the opposing side of the socket (thereby eliminated the need for the axle feature), as further described below in connection with FIGS. 10-12. In this embodiment the lock mechanism(s) would be located along only one side of the module. In yet another embodiment, there can be a lever for each individual lock mechanism (no axle feature).

In the illustrated embodiment (see FIGS. 6-8), there are two levers 222 that control a total of four locks 224 of the locking mechanism 220. However, in another embodiment, there can be a drive axle, or chain or belt, or auger that transfers the kinetic energy from only one lever to all four lock mechanisms (e.g. drive shaft that runs the long direction of the socket and operatively connects the one lever to both axles, thereby rotating all four locks), as described further below in connection with FIGS. 17-18 and 25-37. In yet another embodiment any combination of number of levers to locks can be used.

In the illustrated embodiment, the electrical connection between the linear light module 100 and the socket 200 is made via an electrical contact element 114 of the linear module 100 contacting a corresponding electrical contact member 214 on the socket 200. However, in another embodiment an electrical connection between the linear light module and the socket can be made via other suitable mechanisms (e.g. through the pins 104 on the body 102 of the module 100, as described further below, or through flying lead wires or through other types of electrical connectors).

In yet another embodiment, the module can have a ramp or ramps and the socket can have pins that move along the ramps (the pins activated by the lever(s)), forming a compression force between the LED module and the heat dissipating member, as further discussed below in connection with FIGS. 19-20. In this embodiment the ramps on the module can be spring loaded, or the thermal pad on the bottom of the module can be spring loaded, or the roller pin mechanism in the socket can be spring-loaded. In still another embodiment, the springs or resilient members could be elsewhere within the socket and/or the light module.

Figure 10:
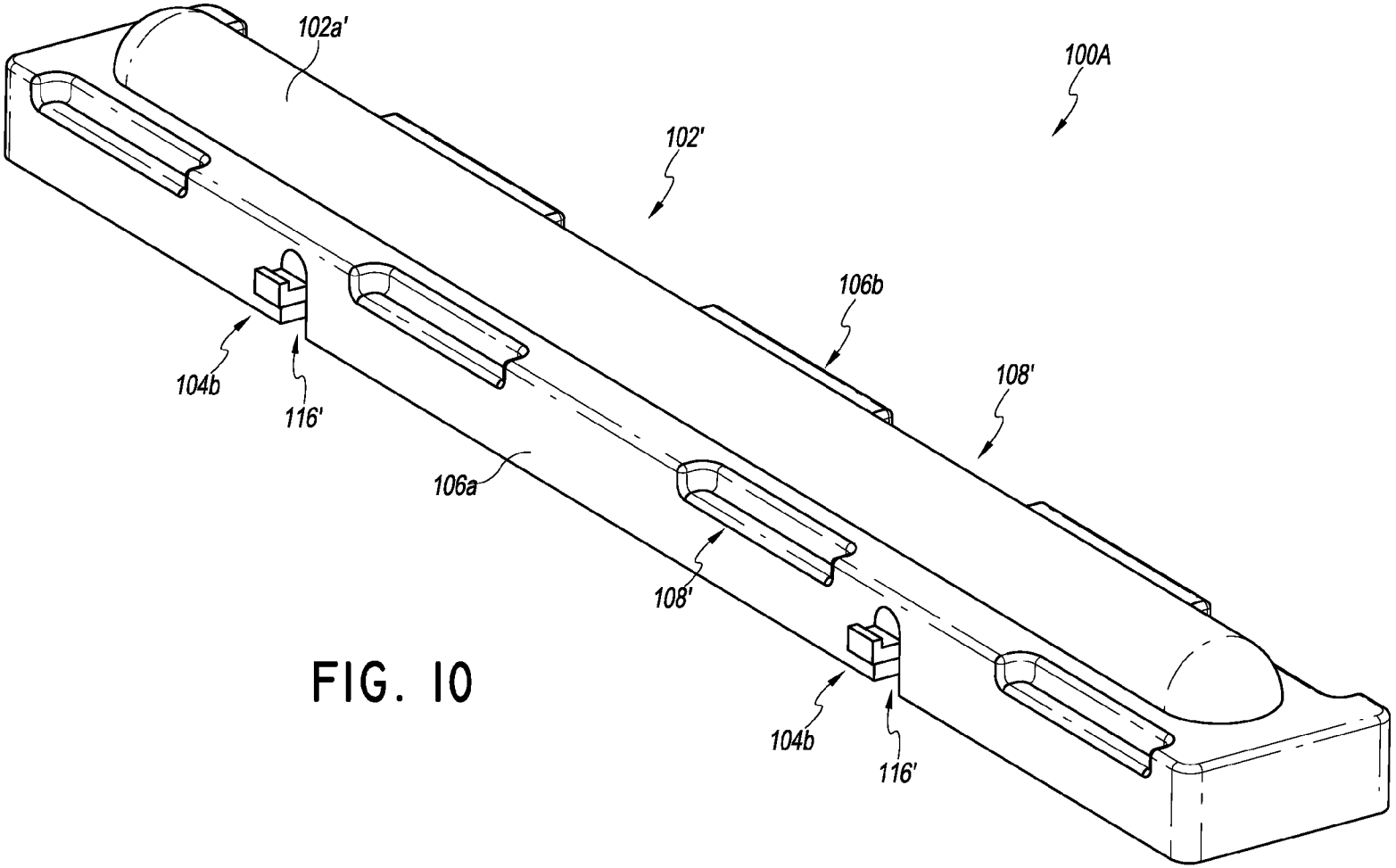
FIG. 10 is a top perspective view of another embodiment of a linear light module.
Figure 11:
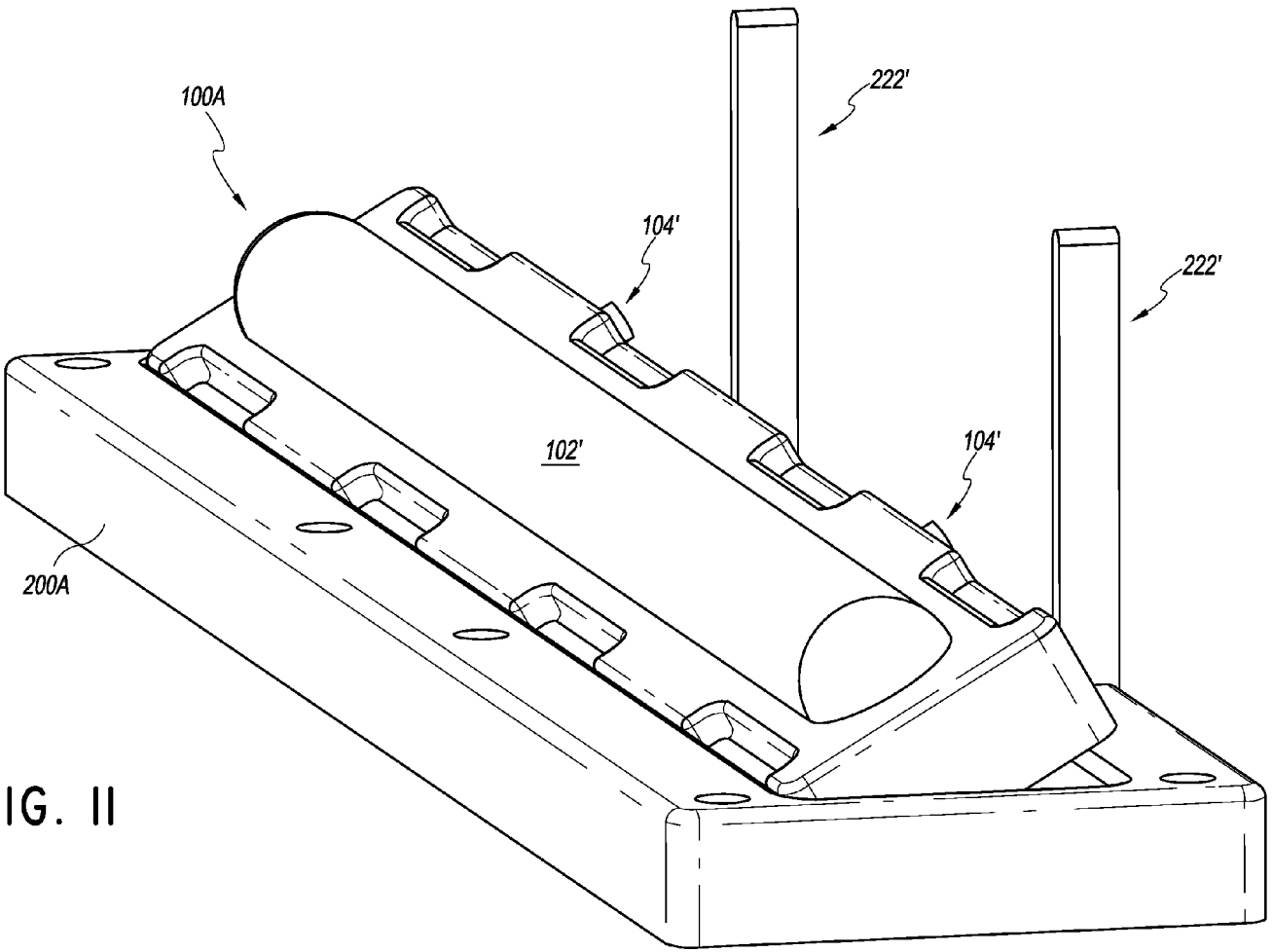
FIG. 11 is a top perspective view of the linear light module of FIG. 10 partially inserted in a corresponding socket.
Figure 12:
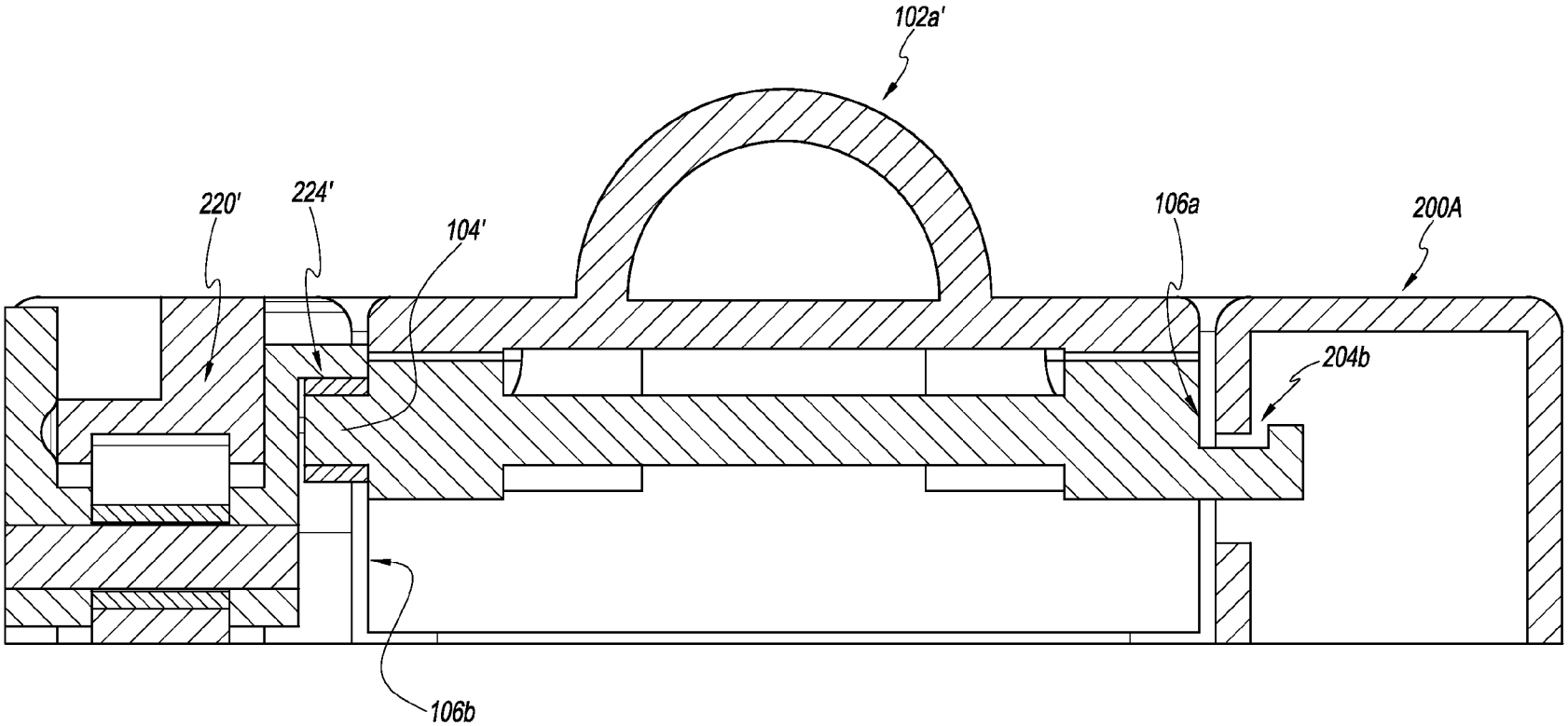
FIG. 12 is a transverse cross-sectional view of the linear light module of FIG. 10 fully installed in the socket of FIG. 11.

FIGS. 10-12 show another embodiment of a linear light module 100A and socket 200A. The linear light module 100A and socket 200A are similar to the linear light module 100 and socket 200, respectively, except as noted below. Thus, the reference numerals used to designate the various components of the linear light module 100A and socket 200A are identical to those used for identifying the corresponding components of the linear light module 100 and socket 200 in FIGS. 1-9, except that a "'" has been added to the reference numerals.

In the illustrated embodiment, the linear light module 100A has pins 104' on one side 106*b* of the module body 102', and has one or more hooks 104*b* on another side (e.g., opposite side) 106*a* of the body 102'. As shown on FIG. 10, the one or more hooks 104*b* can be aligned with one or more recesses or openings 116' in a bottom portion 102*d'* of the module body 102'. In another embodiment, the recesses or openings 116' can be excluded.

As shown in FIGS. 11-12, the socket 200A has one or more levers 222' (in the illustrated embodiment, the socket 200A has two levers 222') that actuate one or more locks 224' of a locking mechanism 220' to releasably lock the one or more pins 104' in the same manner discussed above in connection with the socket 200 and light module 100. The socket 200A also has one or more latches 204*b* on an opposite side of the socket 200A from the one or more locks 224' that can releasably receive and engage the one or more hooks 104*b*, such that the one or more locks 224' and one or more latches 204*b* can lock the linear light module 100B in place in the socket 200A.

With reference to FIG. 11, the light module 100A can be installed in the socket 200A by first inserting the light module 100A at an angle within the socket 200A so that the one or more hooks 104*b* extend past the one or more latches 204*b*. Once the one or more hooks 104*b* have extended into the one or more latches 104*b* (as shown in FIG. 12), the opposite side 106*b* of the module body 102' can be inserted into the socket 200A so that the one or more pins 104' extend through corresponding openings 204' on the surface 202*a'* of the socket 200A and into the corresponding locking chamber 226' of the locking mechanism 220' while the corresponding lever 222' is in the open (e.g., unlocked) position. Once the one or more pins 104' are disposed in their corresponding locking chambers 226', the user can actuate the levers 222' to rotate the one or more locks 224' to lock the pins 104', as discussed above in connection with the socket 200, thereby locking the light module 100A in place in the socket 200A. Therefore, in this embodiment, the socket 200A has locks 224' on only one side of the socket 200A (e.g., the side with the levers 222'), which are directly actuated by their corresponding lever 222'. Accordingly, the socket 200A need not have axles to interconnect locks on opposite sides of the socket 200A, as described above for the socket 200. Though not shown in FIGS. 10-12, the linear light module 100A can have an electrical contact element that contacts an electrical contact member of the socket 200A in a manner similar to that described above in connection with FIGS. 1-9, or can make its electrical connection through other suitable mechanisms, such as through the hooks 104*b* or pins 104', flying lead wires with an electrical connector, etc.

Figure 13:
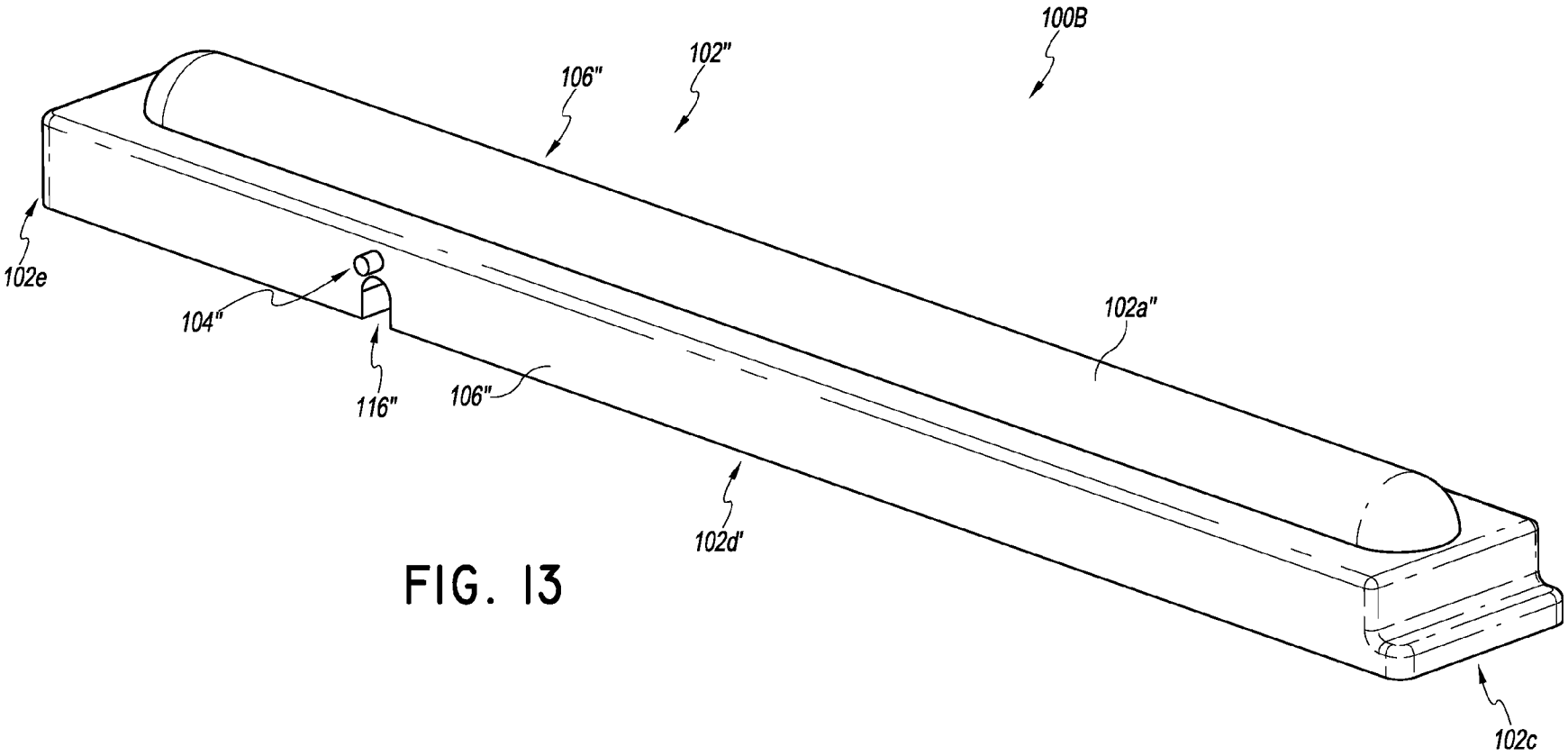
FIG. 13 is a top perspective view of another embodiment of a linear light module.
Figure 14:
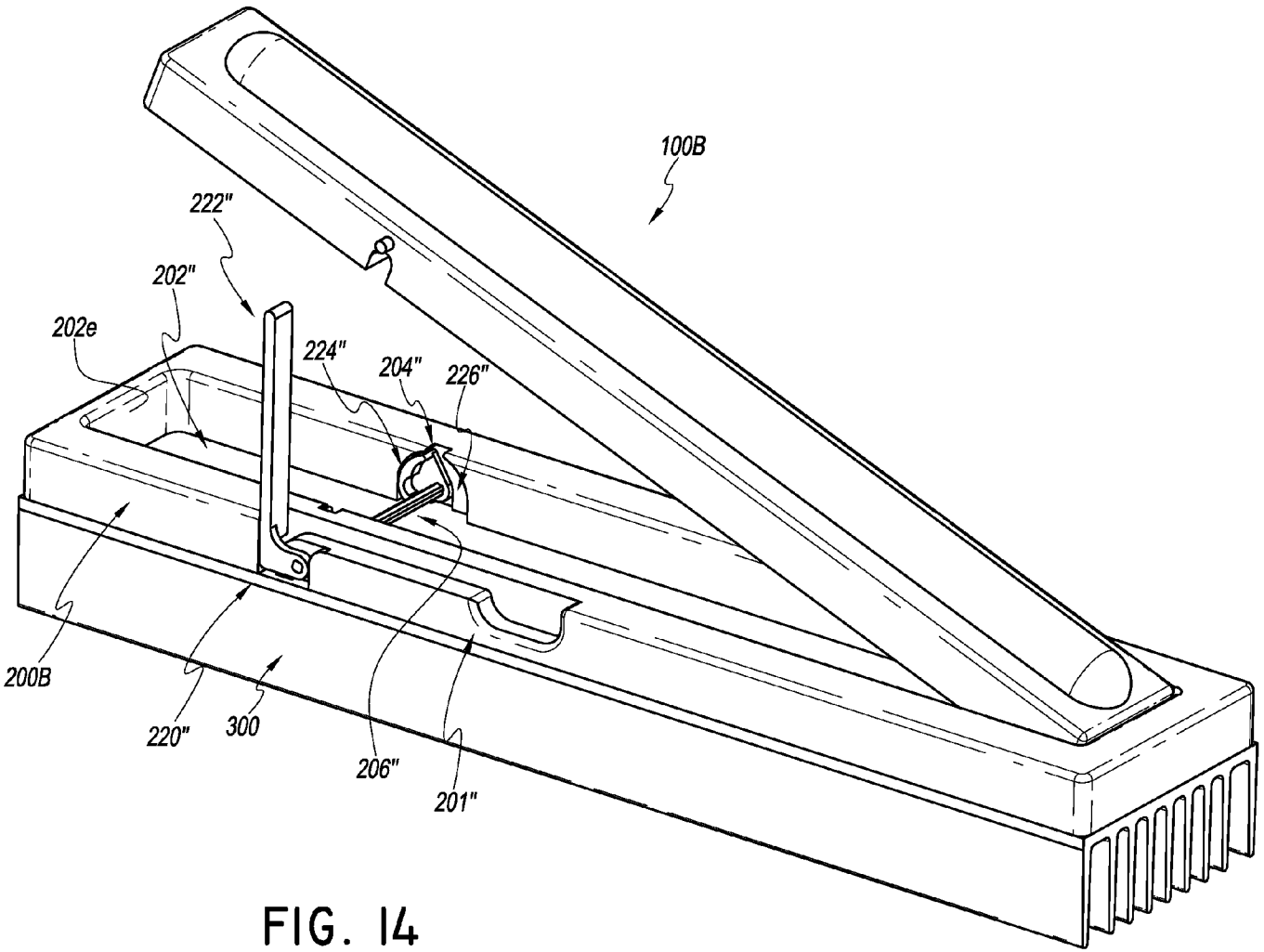
FIG. 14 is a top perspective view of the linear light module of FIG. 13 partially inserted in a corresponding socket.
Figure 15:
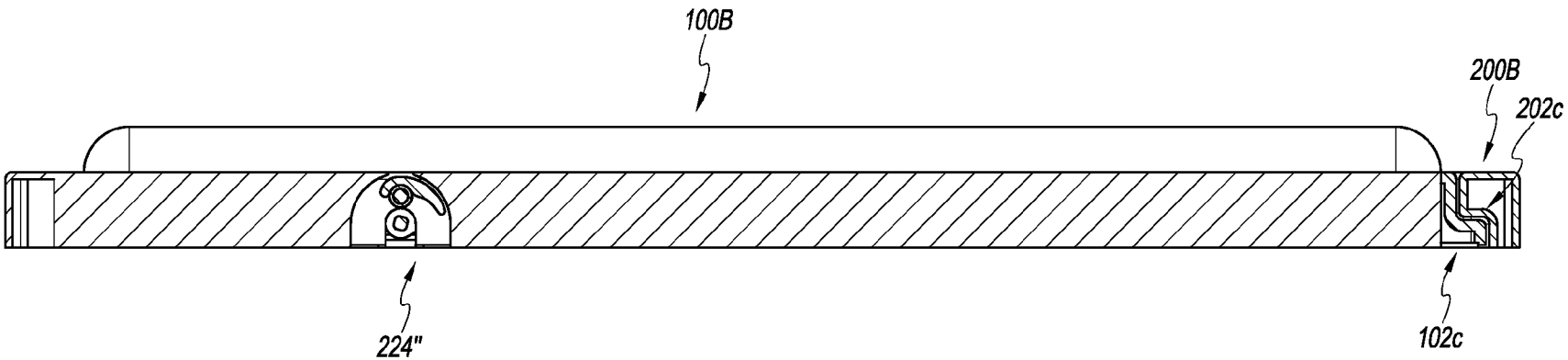
FIG. 15 is a cross-sectional view of the linear light module of FIG. 13 fully installed in the socket of FIG. 14.

FIGS. 13-15 show another embodiment of a linear light module 100B and socket 200B. The linear light module 100B and socket 200B are similar to the linear light module 100 and socket 200, respectively, except as noted below. Thus, the reference numerals used to designate the various components of the linear light module 100B and socket 200B are identical to those used for identifying the corresponding components of the linear light module 100 and socket 200 in FIGS. 1-9, except that a "'" has been added to the reference numerals.

In the illustrated embodiment, the linear light module 100B has a body 102" with one pair of pins 104" aligned with one opening or recess 116" on a bottom portion 102*d"* of the body 102". The body 102" has a generally stepped or hook-like distal end 102*c* and a generally flat or planar proximal end 102*e*. In another embodiment, the opening or recess 116" can be excluded.

As shown in FIGS. 13-15, the linear light module 100B can be installed in the socket 200B attached to the heat sink 300 by first inserting the module body 102" at an angle so that the stepped distal end 102*c* extends into a latch member 202*c* of the socket 200B. The proximal portion of the module body 102" can then be inserted into the opening 202" of the socket 200B such that the generally flat or planar proximal end 102*e* of the module body 102" is adjacent a corresponding flat or planar surface 202*e* of the socket 200B, the pins 104" extend through the openings 204" into the locking chambers 226" (with the lever 222" in the open or unlocked position), and such that the axle 206" extends into the opening or recess 116" on the bottom 102*d"* of the module body 102". The user can then actuate the lever 222" to rotate the locks 224" to lock pins 104" to thereby lock the linear light module 100B in the socket 200B. Therefore, in this embodiment, the socket 200B has only one pair of locks 224" interconnected by the axle 206", and the locks 224" of the locking mechanism 220" can be actuated by a single lever 222". Though not shown in FIGS. 13-15, in another embodiment, the linear module can have a stepped distal end 102*c* on one end of the body 102" and a stepped distal end on the opposite side of the body 102", and a lever mechanism (located within the socket) can clamp down the stepped distal end on either side of the body 102", or both sides of the body 102". Though not shown in FIGS. 13-15, the linear light module 100B can have an electrical contact element that contacts an electrical contact member of the socket 200B in a manner similar to that described above in connection with FIGS. 1-9, or can make its electrical connection through other suitable mechanisms, such as through the pins 104", flying lead wires with an electrical connector, etc.

Figure 14A:
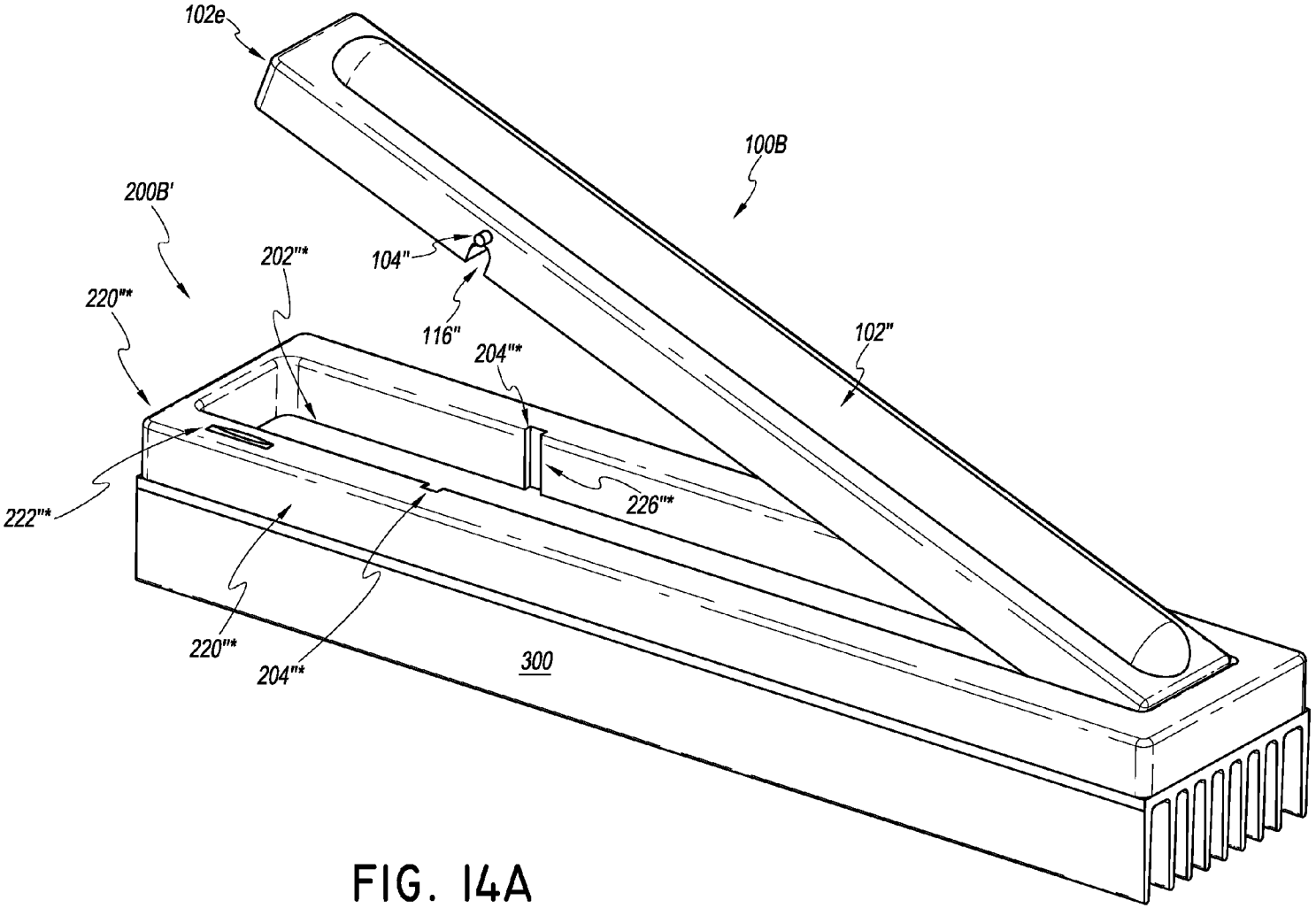
FIG. 14A is a top perspective view of the linear light module of FIG. 13 partially inserted in another embodiment of a socket.

FIG. 14A shows the linear light module 100B being installed in another embodiment of a socket 200B'. The socket 200B' is similar to the socket 200B, except as noted below. Thus, the reference numerals used to designate the various features of the socket 200B' are identical to those used in identifying the corresponding features of the socket 200B in FIG. 14, except than an "*" has been added to the reference numerals.

In the illustrated embodiment, the locking mechanism 220"* of the socket 200B' can exclude the lever 222", axle 206" and lock 224" features. Rather, the socket 200B' can have one or more openings 204"* that receive the pins 104" of the module body 102" therein, the pins 104" extending into recesses 226"* in the socket 200B'. Although FIG. 14A shows pins 104" and openings 204"* that receive the pins 104", other suitable mechanisms can be used (e.g. one or more hooks or latches on the sides or underside of the module body 102" that engage with one or more latches or one or more catch mechanisms on the socket 200B'). The module body 102" can be inserted into the socket 200B' in the same inclined manner described above in connection with FIG. 14 (e.g., inserting the stepped or hook-like distal end 102*c* of the module body 102" first). When the proximal end 102*e* of the module body 102" is inserted into the opening 202"* of the socket 200B', the module body 102" actuates one or more latches or one or more catch mechanisms (not shown) that locks the module body 102" in place within the socket 200B'. To release the module body 102" (e.g., unlock the locking mechanism 220"*), to allow the module body 102" to be withdrawn from the socket 200B', the user can press a release member (e.g., button) 222", which releases the latch or catch and, optionally, can push the proximal end 102*e* of the module body 102" at least partially out of the socket 200B'.

In another embodiment, the hook-like distal end 102*c* can be excluded, and the module body 102" can be inserted directly into the socket 200B' and pushed down into place, which actuates one or more latches or one or more catch mechanisms (not shown) that act to lock the module body 102" in place within the socket 200B'. In the embodiments described above, when the module body 102" is installed into the socket 200B', a thermal connection or thermal coupling can be formed between at least a surface of the module body 102" and at least a surface of the socket or the light fixture or heat dissipating member (e.g. heat sink, active cooling, etc.). In the embodiments described above, the one or more thermal pads on the bottom side of the module body 102" can be spring loaded or a compressible thermal pad can be used. In still another embodiment, the springs or resilient members could be elsewhere between the socket and the light module body. Though not shown in FIG. 14A, the linear light module 100B can have an electrical contact element that contacts an electrical contact member of the socket 200B' in a manner similar to that described above in connection with FIGS. 1-9, or can make its electrical connection through other suitable mechanisms, such as through the pins 104", flying lead wires with an electrical connector, etc.

Figure 16:
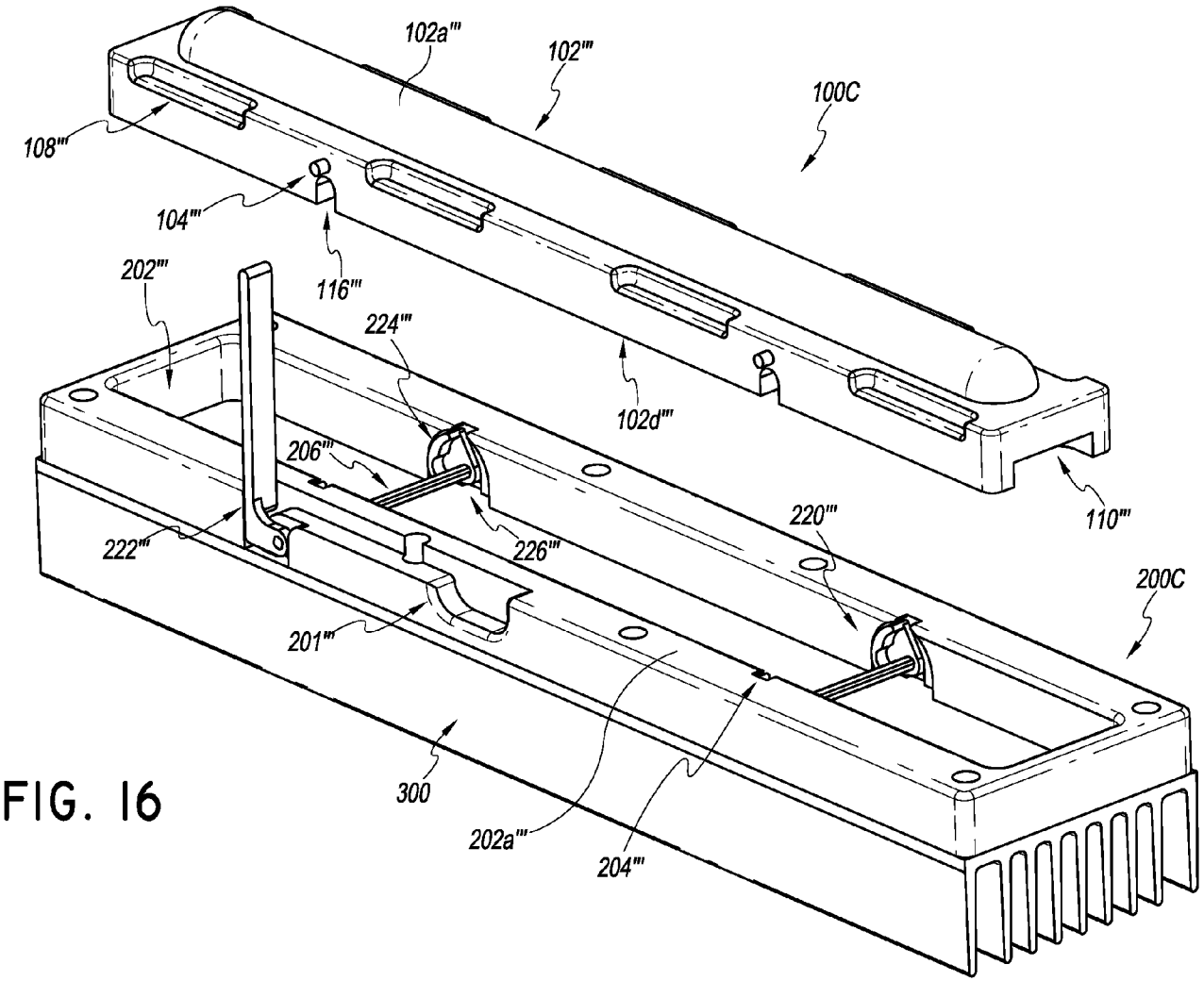
FIG. 16 is a top perspective view of one embodiment of a linear light module spaced apart from another embodiment of a socket prior to installation of the linear light module in the socket with the locking mechanism in an open position.
Figure 17:
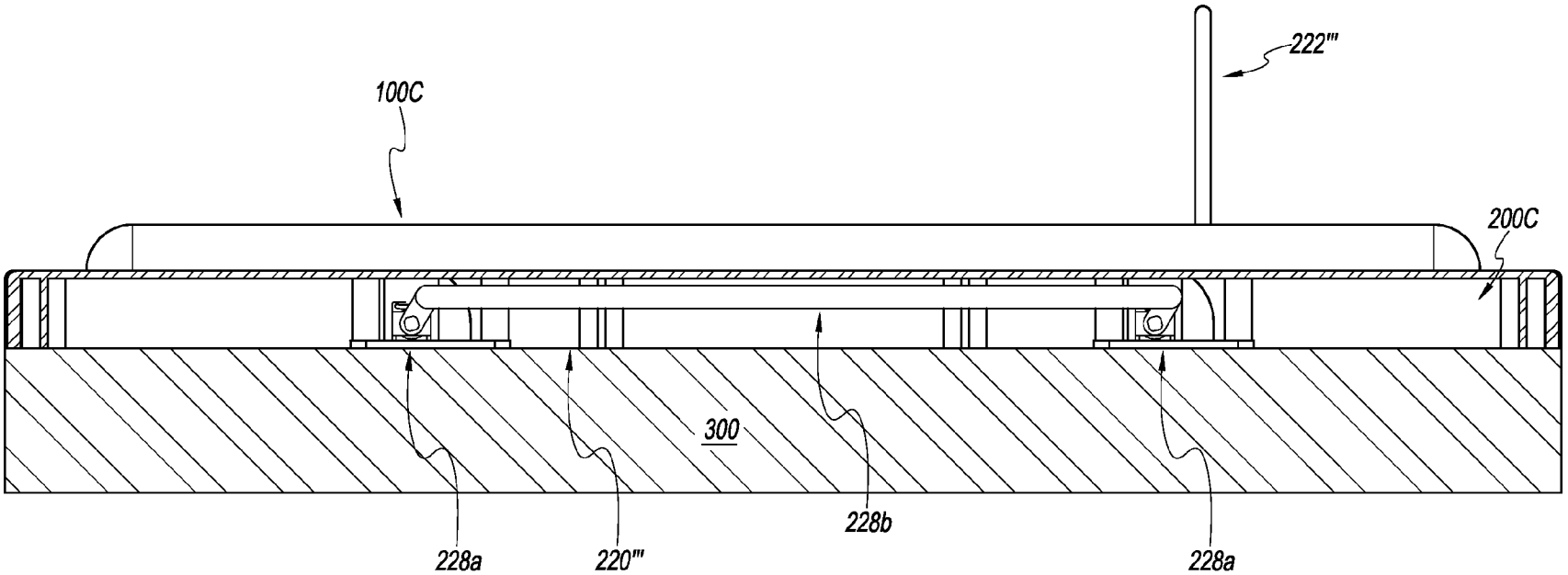
FIG. 17 is a cross-sectional longitudinal view of the linear light module of FIG. 16 installed in the socket of FIG. 16 with the locking mechanism in the open position.
Figure 18:
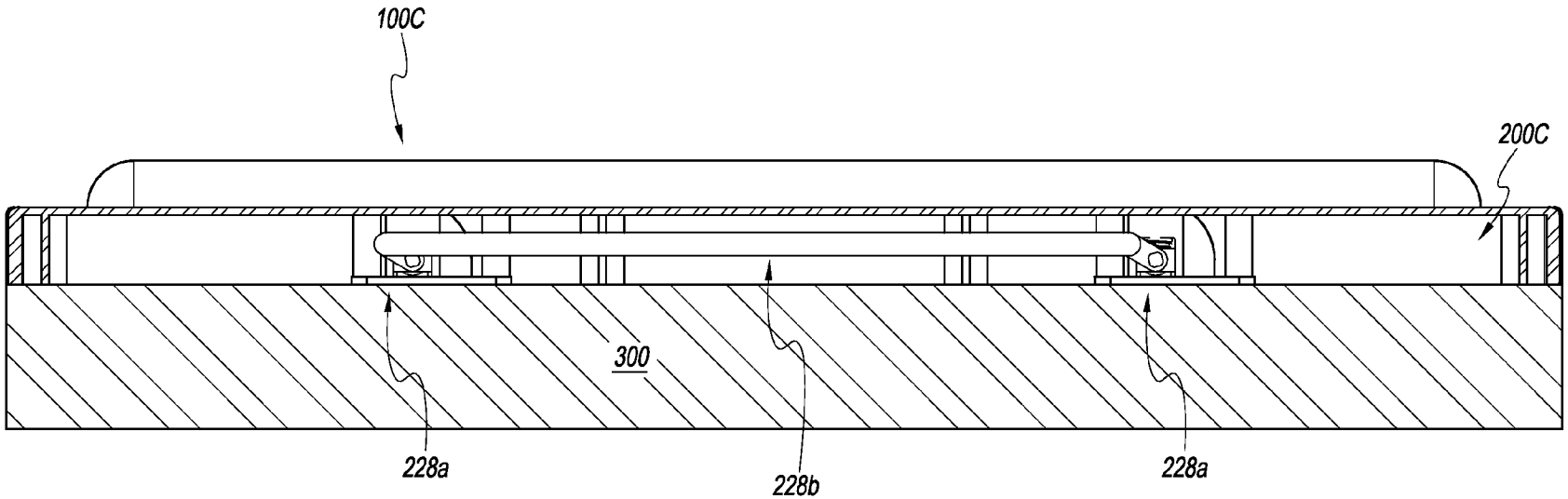
FIG. 18 is a cross-sectional longitudinal view of the linear light module of FIG. 16 installed in the socket of FIG. 16 with the locking mechanism in the closed position.

FIGS. 16-18 show another embodiment of a linear light module 100C and socket 200C. The linear light module 100C and socket 200C are similar to the linear light module 100 and socket 200, respectively, except as noted below. Thus, the reference numerals used to designate the various components of the linear light module 100C and socket 200C are identical to those used for identifying the corresponding components of the linear light module 100 and socket 200 in FIGS. 1-9, except that a "'''" has been added to the reference numerals.

In the illustrated embodiment, the linear light module 100C has a module body 102''' similar to the light module body 102 of the linear light module 100, with one or more pins 104''' and one or more openings or recesses 116''' on a bottom 102*d*''' of the module body 102'''. As shown in FIG. 16, the pins 104''' and openings or recesses 116''' are generally aligned with each other.

The linear light module 100C can be installed in the socket 200C by inserting the module body 102''' an opening 202''' of the socket 200C such that the pins 104''' pass through openings 204''' in a top surface 202*a*''' of the socket 200C and into locking chamber 226''' (with the lever 222''' in the open or unlocked position), and so that one or more axles 206''' of the locking mechanism 220''' extend into corresponding openings or recesses 116''' in the module body 102'''. In another embodiment (not shown) the one or more axles 206''' can be disposed at one or both of the ends of the socket 200C, so that the recesses 116''' in the module body 102''' can be excluded. Once the pins 104''' are in the locking chambers 226''', the user can actuate the lever 222''' to rotate the one or more locks 224''' of the locking mechanism 220''' to lock the pins 104''' in the locking chambers 226''', thereby locking the linear light module 100C in the socket 200C.

In the embodiments described above, when the module body 102''' is installed into the socket 200C, a thermal connection or thermal coupling can be formed between at least a surface of the module body 102''' and at least a surface of the socket 200C or the light fixture or heat dissipating member 300 (e.g. heat sink, active cooling, etc.). In the embodiments described above, the one or more thermal pads on the bottom side of the module body 102''' can be spring loaded or a compressible thermal pad can be used, or the pins on the body 102''' of the module 100C can be spring loaded, or the cams or locking mechanisms 220''' can be spring loaded. In still another embodiment, the springs or resilient members could be elsewhere between the socket 200C and the light module body 102'''. Though not shown in FIGS. 16-18, the linear light module 100C can have an electrical contact element that contacts an electrical contact member of the socket 200C in a manner similar to that described above in connection with FIGS. 1-9, or can make its electrical connection through other suitable mechanisms, such as through the pins 104''', flying lead wires with an electrical connector, etc.

As shown in FIGS. 17-18, the locking mechanism 220''' includes one or more cams 228*a* coupled to the one or more locks 224''' so that the cams 228*a* pivot along with the locks 224'''. In the illustrated embodiment, the socket 200C has four locks 224''', two on each side of the socket 200C, and so has four cams 228*a* associated with the four locks 224'''. In another embodiment (not shown), there can be any number of locks or cams. The cams 228*a* on each side of the socket 200C are interconnected by a cam arm 228*b*, so that movement (e.g., pivoting or rotation) of one of the cams 228*a* causes movement (e.g., pivoting or rotation) of the other cam 228*a* on the same side of the socket 200C due to the movement (e.g., translation) of the cam arm 228*b*. The cam arm 228*b* can move within a recess, opening or channel in the body of the socket 200C. Additionally, as discussed previously, the locks 224''' on opposite sides of the socket 200C are interconnected by the axle 206''', so that rotation of one of the locks 224''' causes rotation of the lock 224''' on the opposite side of the socket 200C. Accordingly, the one or more axles 206''', and the cams 228*a* and cam arms 228*b*, allow the actuation of multiple locks 224''' with a single lever 222''', when the lever 222''' is moved between the open or unlocked position (see FIG. 17) and the closed or locked position (see FIG. 18).

Figure 19:
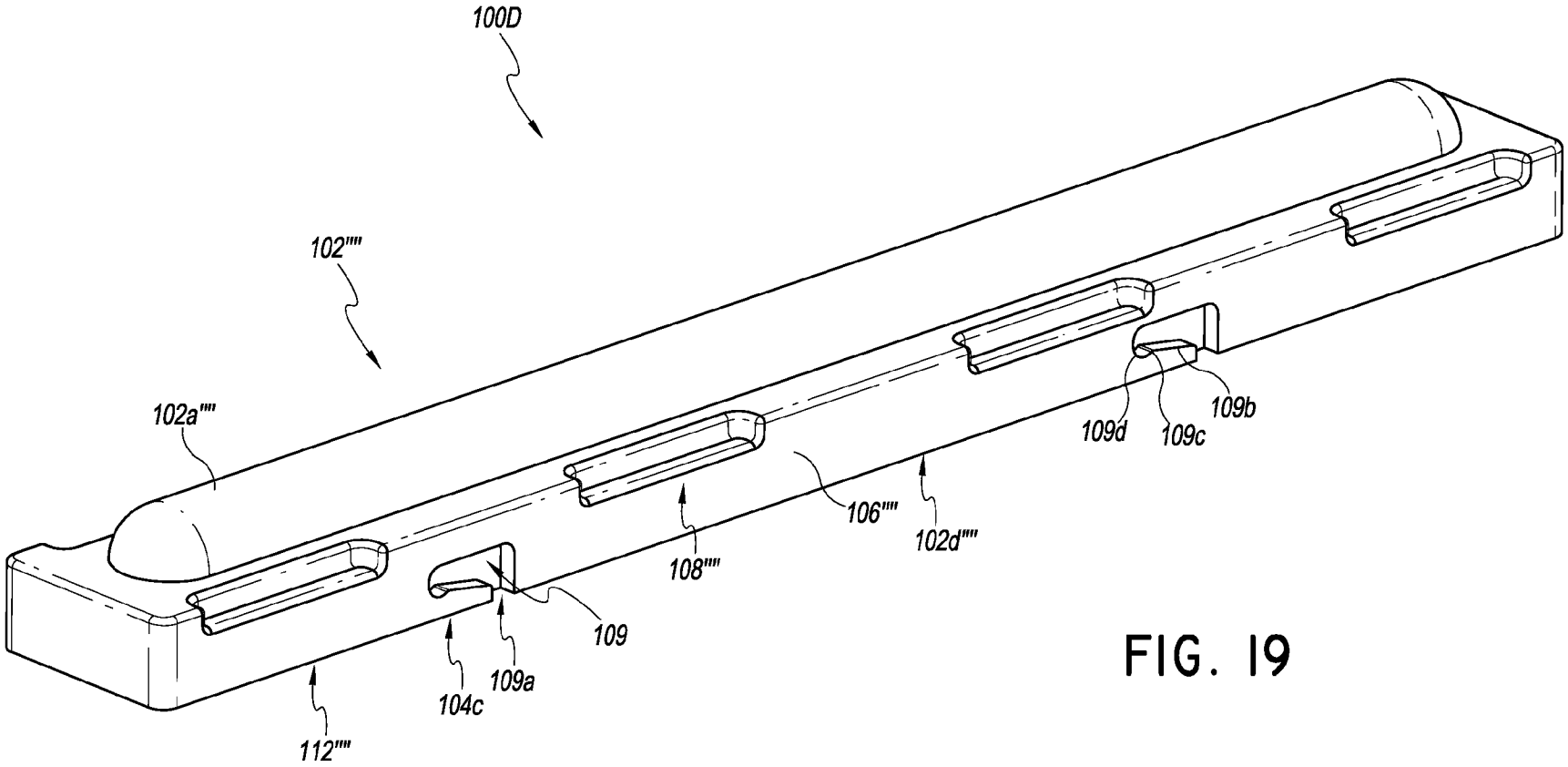
FIG. 19 is a top perspective view of another embodiment of a linear light module.
Figure 20:
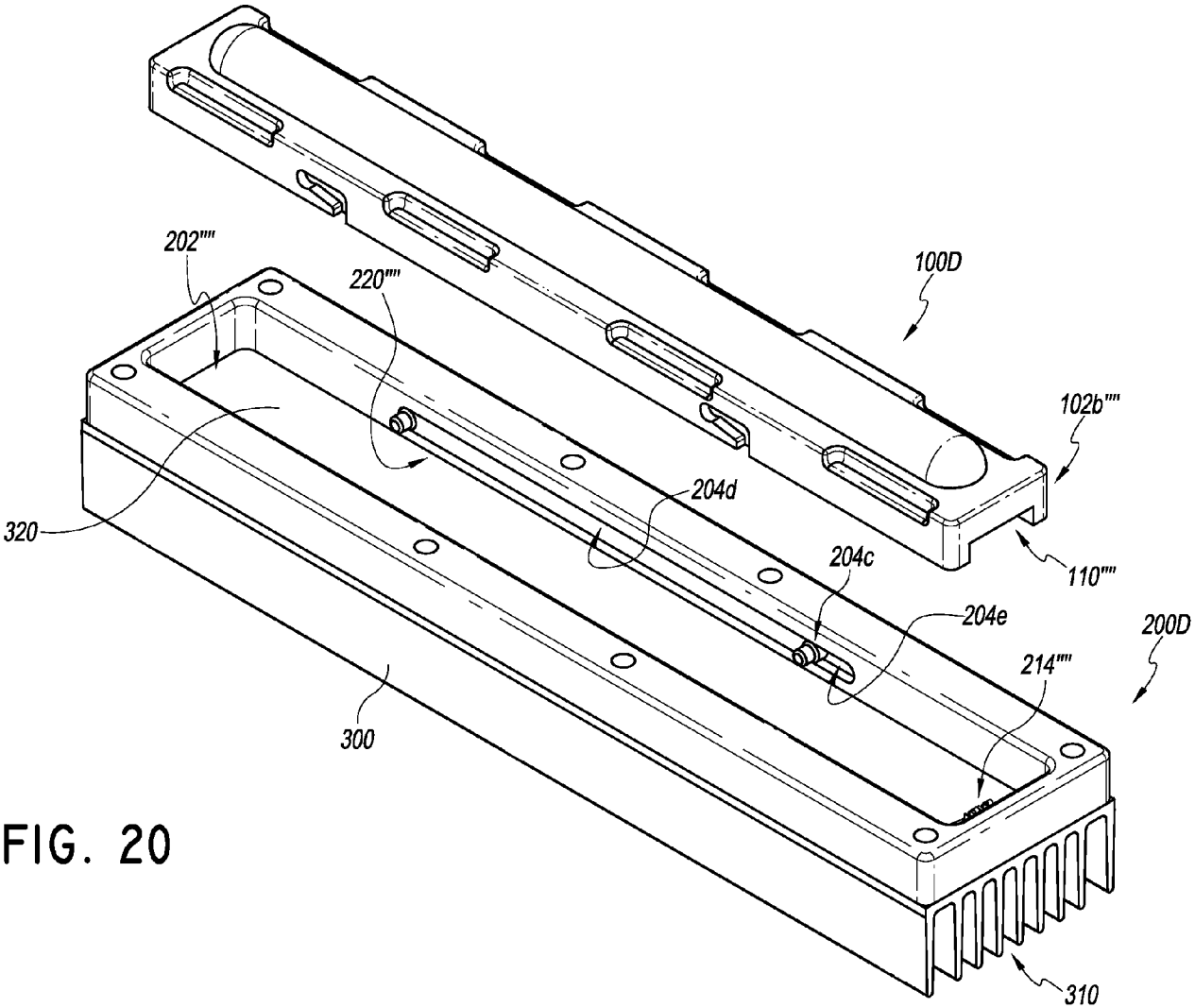
FIG. 20 is a top perspective view of the linear light module of FIG. 19 spaced apart from another embodiment of a socket prior to installation of the linear light module in the socket.
Figure 2I:
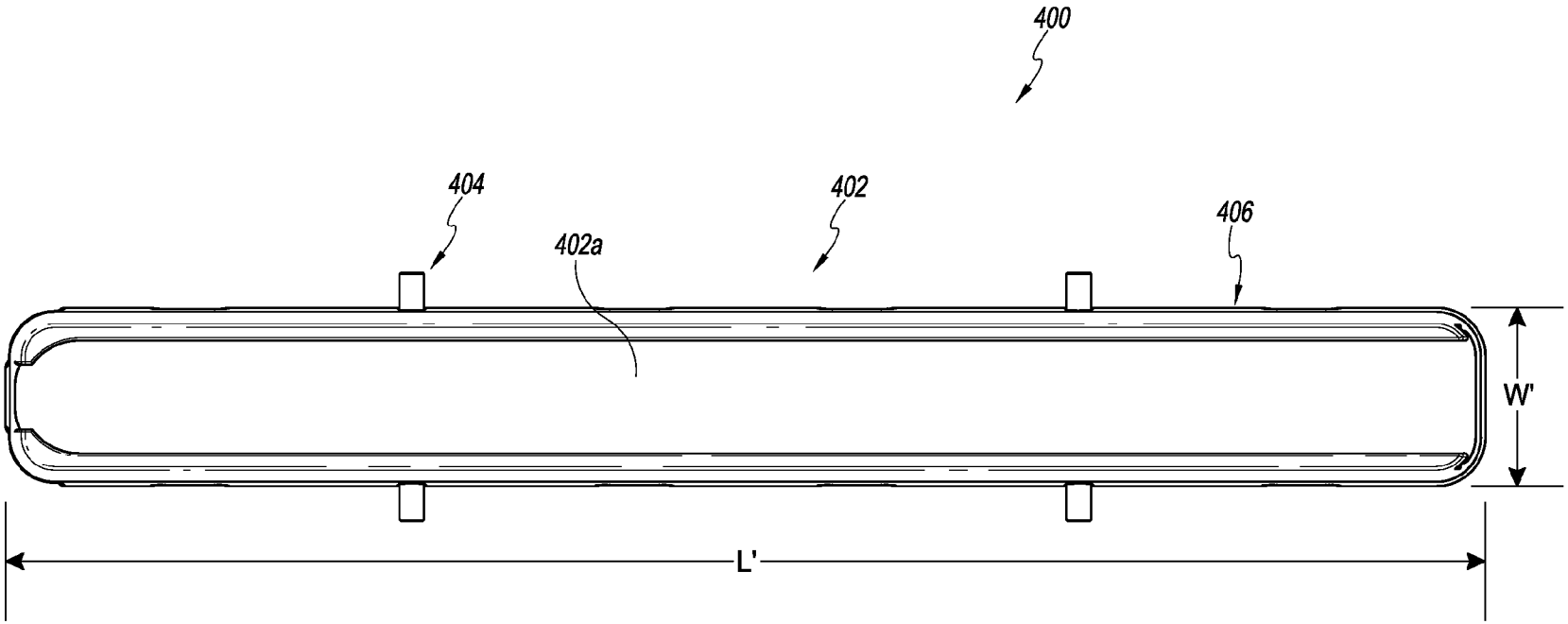

FIGS. 19-20 show another embodiment of a linear light module 100D and socket 200D. The linear light module 100D and socket 200D are similar to the linear light module 100 and socket 200, respectively, except as noted below. Thus, the reference numerals used to designate the various components of the linear light module 100D and socket 200D are identical to those used for identifying the corresponding components of the linear light module 100 and socket 200 in FIGS. 1-9, except that a """" has been added to the reference numerals.

As shown in FIGS. 19-20, the linear light module 100D is similar to the linear light module 100, having a module body 102"" one or more recesses 108"" on a top surface 102*a*"" of the module body 102"", and a recess 110"" at one end 102*b*"" thereof that extends from a bottom 102*d*"" of the module body 102"". However, instead of pins 104, the linear light module 100D has one or more latch members 104*c*. In the illustrated embodiment, the module body 102"" has two latch members 104*c* on one side and two latch member 104*c* on an opposite side of the module body 102"". However, the linear light module 100D can have any number of latch members 104*c* on either side of the module body 102"". Each latch member 104*c* can include a recess 109 in a side 106"" of the module body 102"". The recess 109 can have an opening 109*a* on a bottom surface 112"" of the module body 102"" allowing access to the recess 109, a ramp member 109*b* that is inclined between the opening 109*a* and an apex 109*c*, and a catch member 109*d* adjacent the apex 109*c* and on an opposite side of the apex 109*c* from the ramp member 109*b*.

With reference to FIG. 20, the socket 200D has an opening 202"" sized to receive the module body 102"" therein, and an electrical contact member 214"" that can contact an electrical contact element (not shown) in the recess 110"" of the module body 102"", which can themselves be electrically connected to one or more lighting elements (e.g., LEDs) or to an internal LED driver circuit, or to a surge protection circuit, or other circuits within the linear light module 100D. Although not shown, other suitable mechanisms of forming an electrical connection between the socket and the linear LED module can be used, such as through the pins 204*c* in the socket, through a flying lead wire or wires, etc. The socket 200D can include a locking mechanism 220"" that includes one or more pins 204*c* interconnected by an arm 204*d* that moves (e.g., slides) in a recess or opening 204*e* on an inner surface of the socket 200D. Movement of the arm 204*d* and pins 204*c* can be actuated by a lever (not shown), similar to the lever 222 in FIG. 6, where movement of the lever can cause the translation of the arm 204*d* and pins 204*c*.

In use, the linear light module 100D can be inserted into the opening 202"" of the socket 200D so that each pin 204*c* extends through the opening 109*a* of a corresponding latch member 104*c* and into the recess 109 of the latch member 104*c*. As the pins 204*c* and arm 204*d* are translated (e.g., via actuation of the lever), each pin 204*c* moves along the ramp member 109*b* of the corresponding latch member 104*c*, past the apex 109*c* and into the catch member 109*d*, locking the pin 204 in the latch member 104*c*, and thereby locking the linear light module 100D in the socket 200D. Additionally, as the pins 2004*c* move upward within the recess 109 while traveling on the ramp member 109*b*, the module body 102"" is moved downward toward the heat sink 300 to provide resilient contact between the bottom surface 112"" of the module body 102"" and a surface 320 of the heat sink 300. As discussed previously, such contact allows transfer of heat from the linear light module 100D to the heat sink 300. In the embodiments described above, the one or more thermal pads on the bottom side 102*d*"" of the module body 102"" can be spring loaded or a compressible thermal pad can be used, or the pins 204*c* in the socket 200D can be spring loaded, or the latch member 104*c* (or portion of the latch member) on the linear LED module 100D can be spring loaded. In still another embodiment, the springs or resilient members could be elsewhere between the socket 200D and the light module body 102"".

Figure 22:
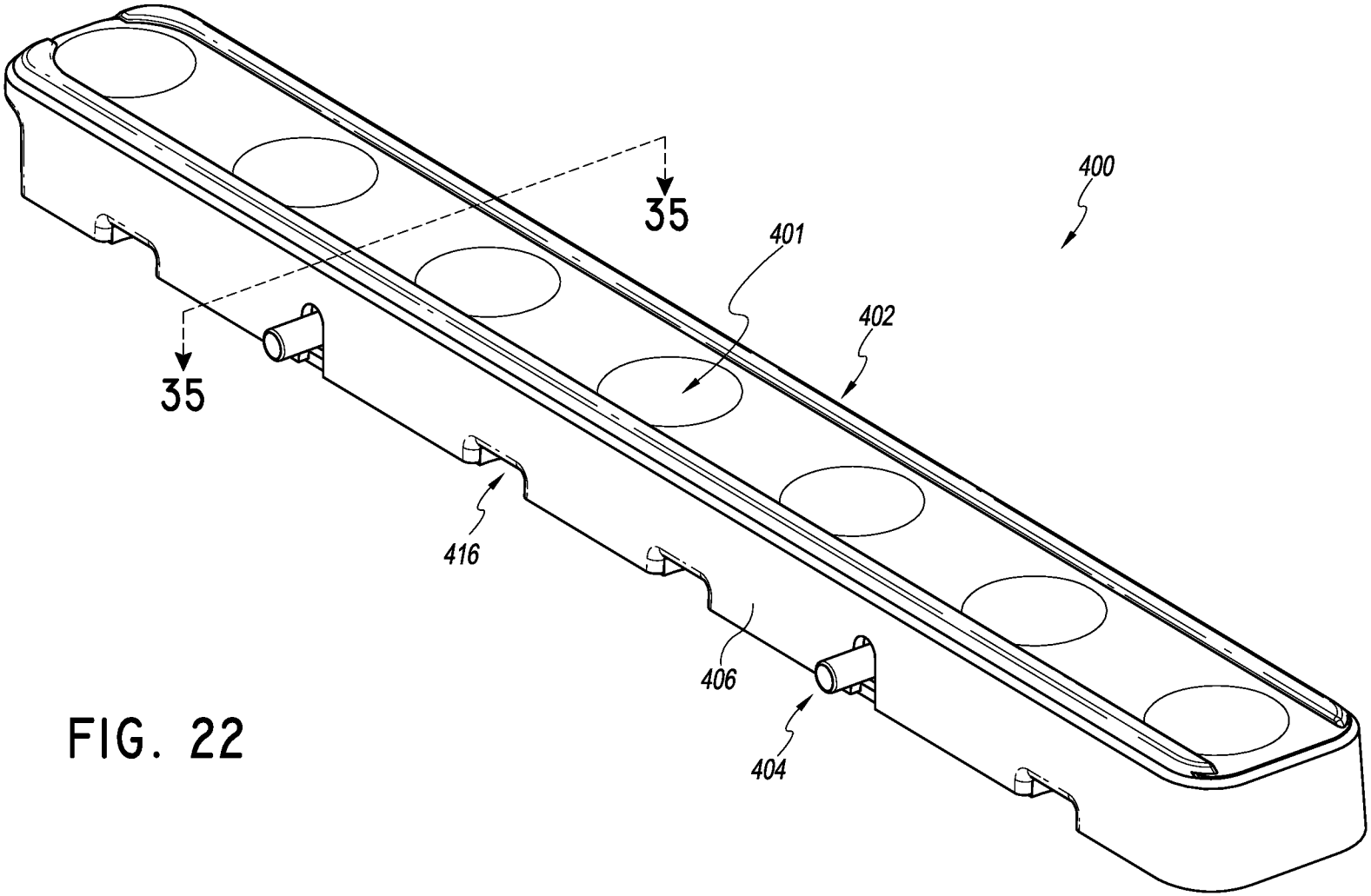
FIG. 22 is a top perspective view of the linear light module of FIG. 21.

FIGS. 21-37 show another embodiment of a linear light module 400 and socket 500. The linear light module 400 can have one or more LED light elements 401 (e.g., spaced apart along a length L' of the linear light module 400) that can provide light through an upper portion 402*a* of a module body 402 of the linear light module 400. As shown in FIGS. 21-22, the linear light module 400 can have one or more pins 404 that extend from a side 406 of the module body 402. In the illustrated embodiment, the module body 402 has a plurality of pins 404 that extend from opposite sides 406 of the body 402. As shown in FIG. 21, the length L' of the module body 402 can be greater than a width W' of the module body 402.

Figure 23:
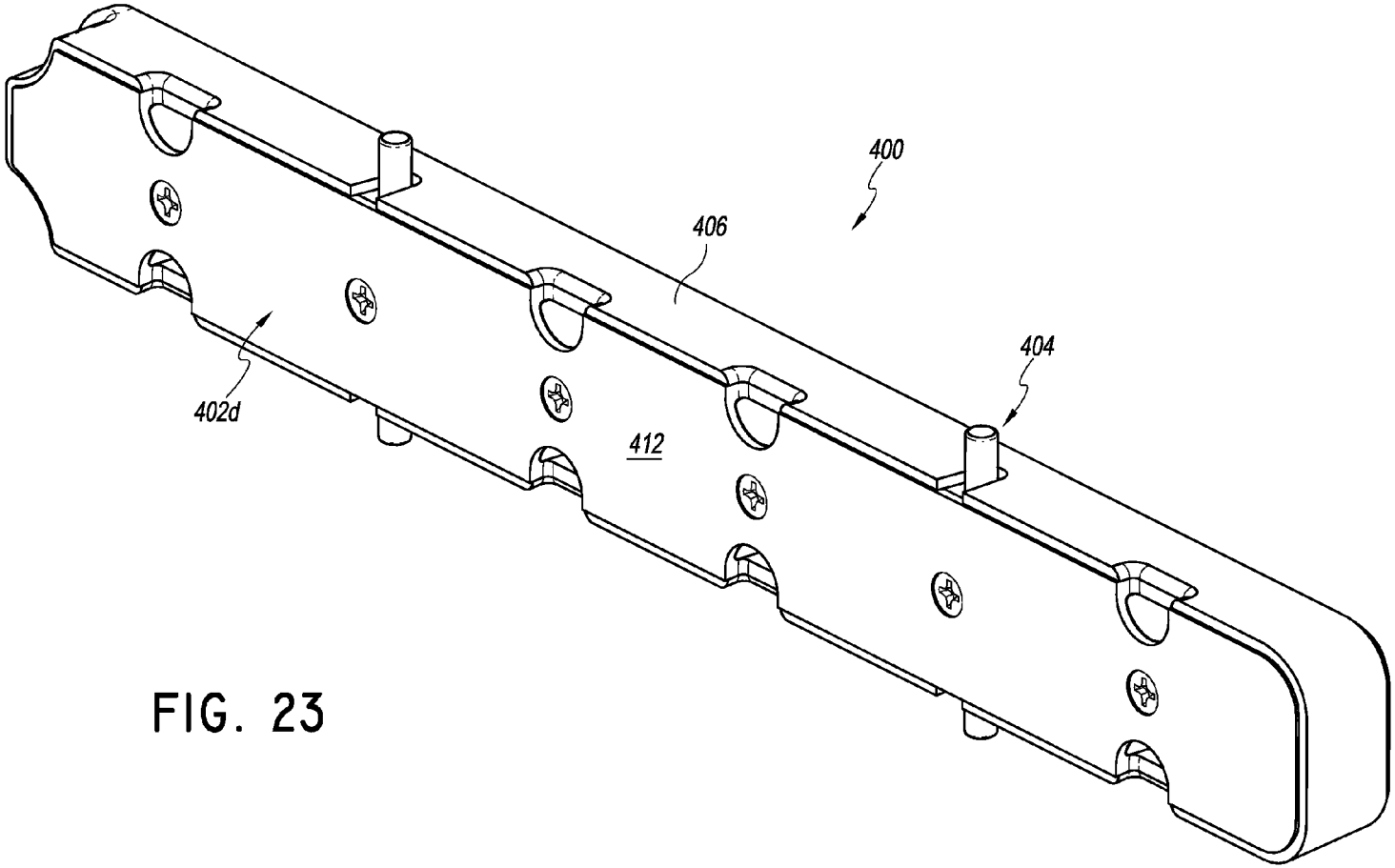
FIG. 23 is a bottom perspective view of the linear light module of FIG. 21.

With reference to FIGS. 22-23, the linear light module 400 can have one or more slots, recesses or openings 416 formed in the bottom 402*d* of the module body 402 that extend from both sides of the module body 402 generally transverse to the longitudinal axis X of the module body 102. A bottom surface 412, or a portion of the bottom surface 412, of the linear light module 400 can be a thermally conductive surface such that heat generated by the one or more LED lighting elements 401 can be transferred to the thermally conductive bottom surface 412 of the module body 402, through which heat can be transferred to the heat dissipating member 600, as discussed below.

Figure 24:
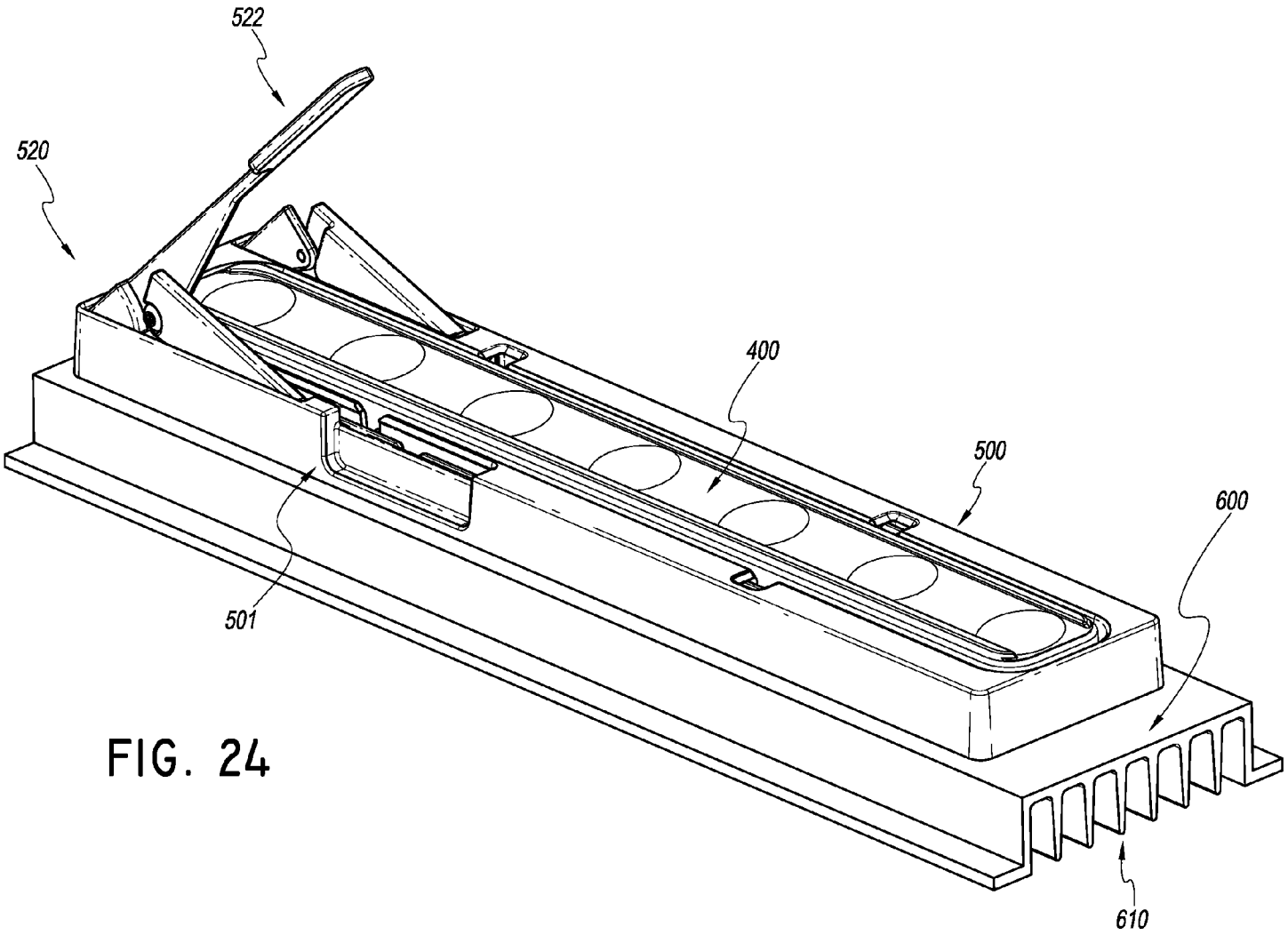
FIG. 24 is a is a top perspective view of the linear light module of FIG. 21 installed in a corresponding socket attached to a heat dissipating member, with the locking mechanism in an open position.
Figure 25:
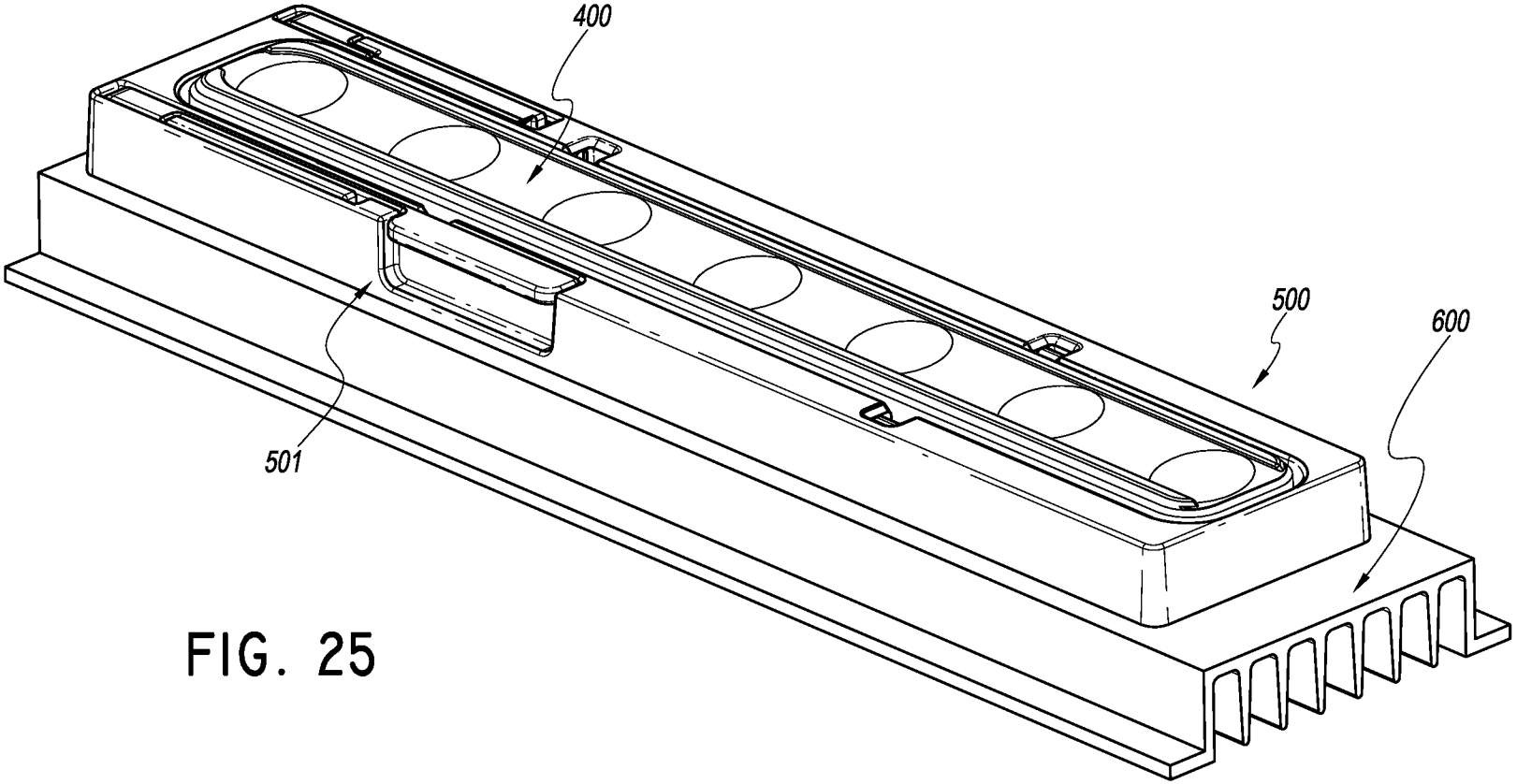
FIG. 25 is a top perspective view of the linear light module of FIG. 21 installed in a corresponding socket attached to a heat dissipating member, with the locking mechanism in a closed position.

FIG. 24 shows the linear light module 400 inserted into the socket 500, with the socket 500 coupled to the heat sink 600, which can have one or more fins 610 for dissipating heat transferred to the heat sink 600 from the linear light module 400. The socket 500 can have a locking mechanism 520 for locking the linear light module 400 to the socket 500, as described further below. The locking mechanism 520 can be actuated by a user via a lever 522, by moving the lever 522 between an open or unlocked position and a closed or locked position, as shown in FIG. 25. The socket 500 can have a recess or opening 501 to allow the user to access at least a portion of the lever 522 when in the closed position, to engage the lever 522 (e.g., with the user's finger(s)) to move the lever 522 to the open or unlocked position for removing the linear light module 400 from the socket 500.

Figure 26:
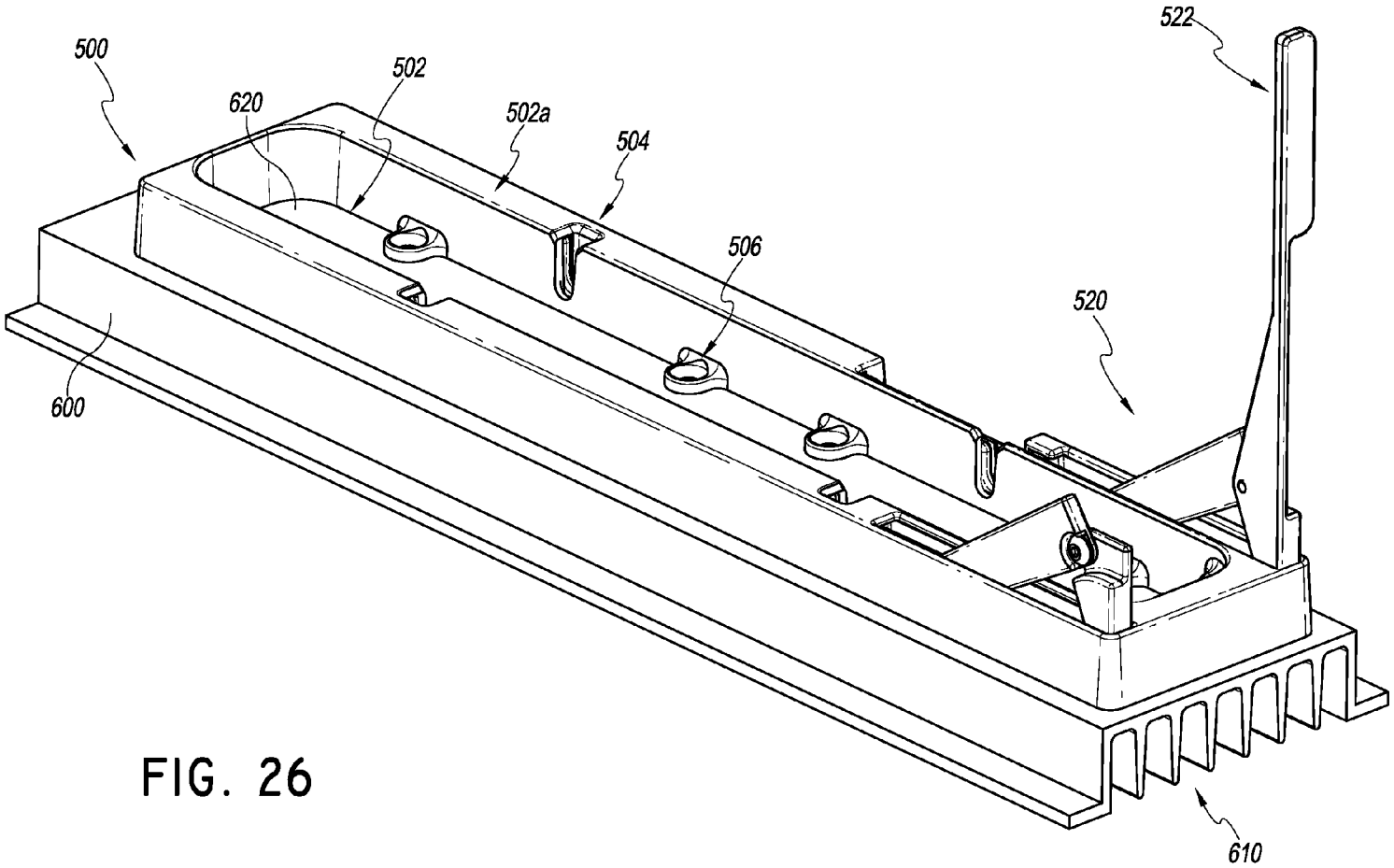
FIG. 26 is a top perspective view of the socket of FIG. 24 attached to the heat dissipating member with the locking mechanism in a fully open position.
Figure 27:
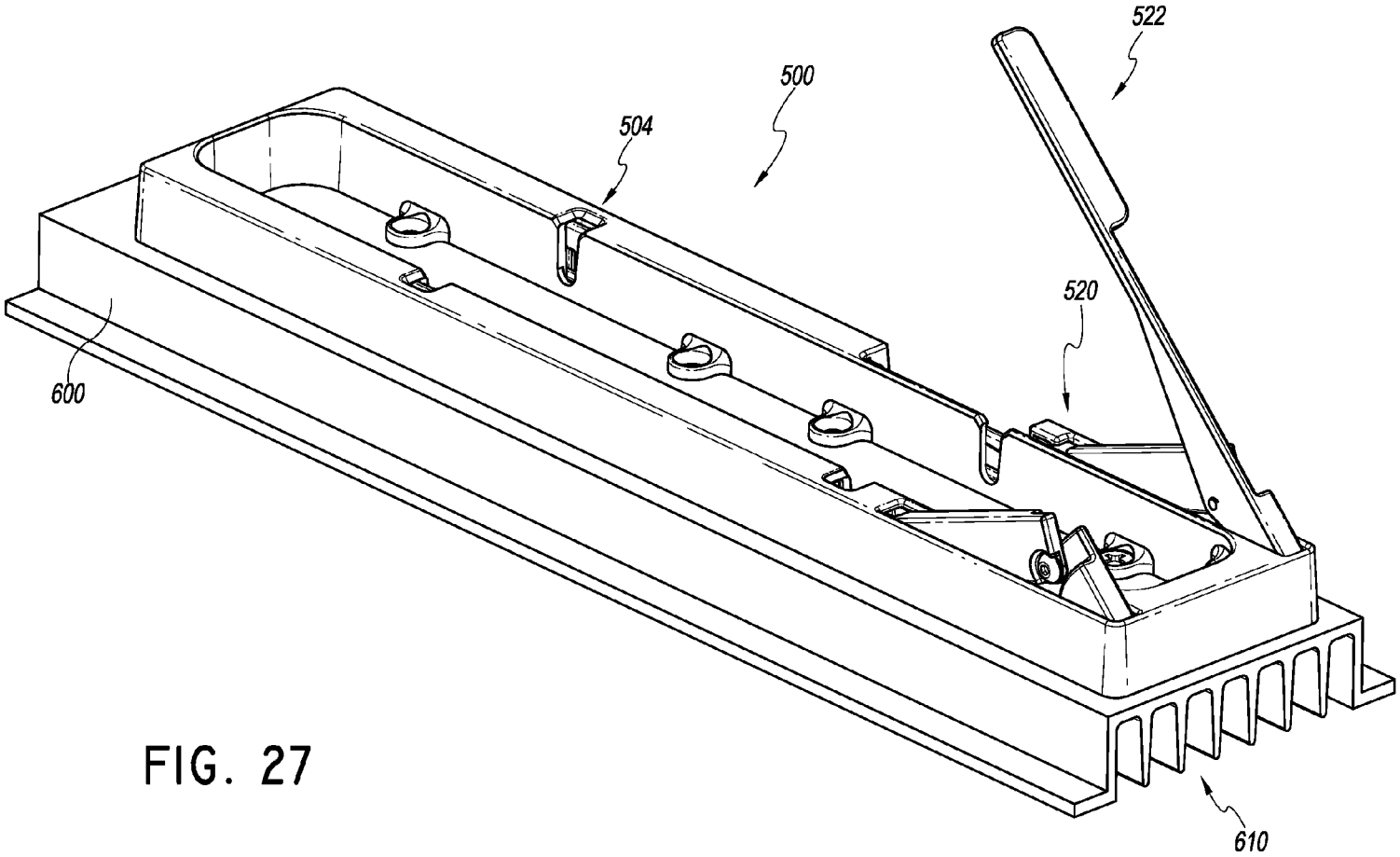
FIG. 27 is a top perspective view of the socket of FIG. 24 attached to the heat dissipating member, with the locking mechanism in an open position.
Figure 28:
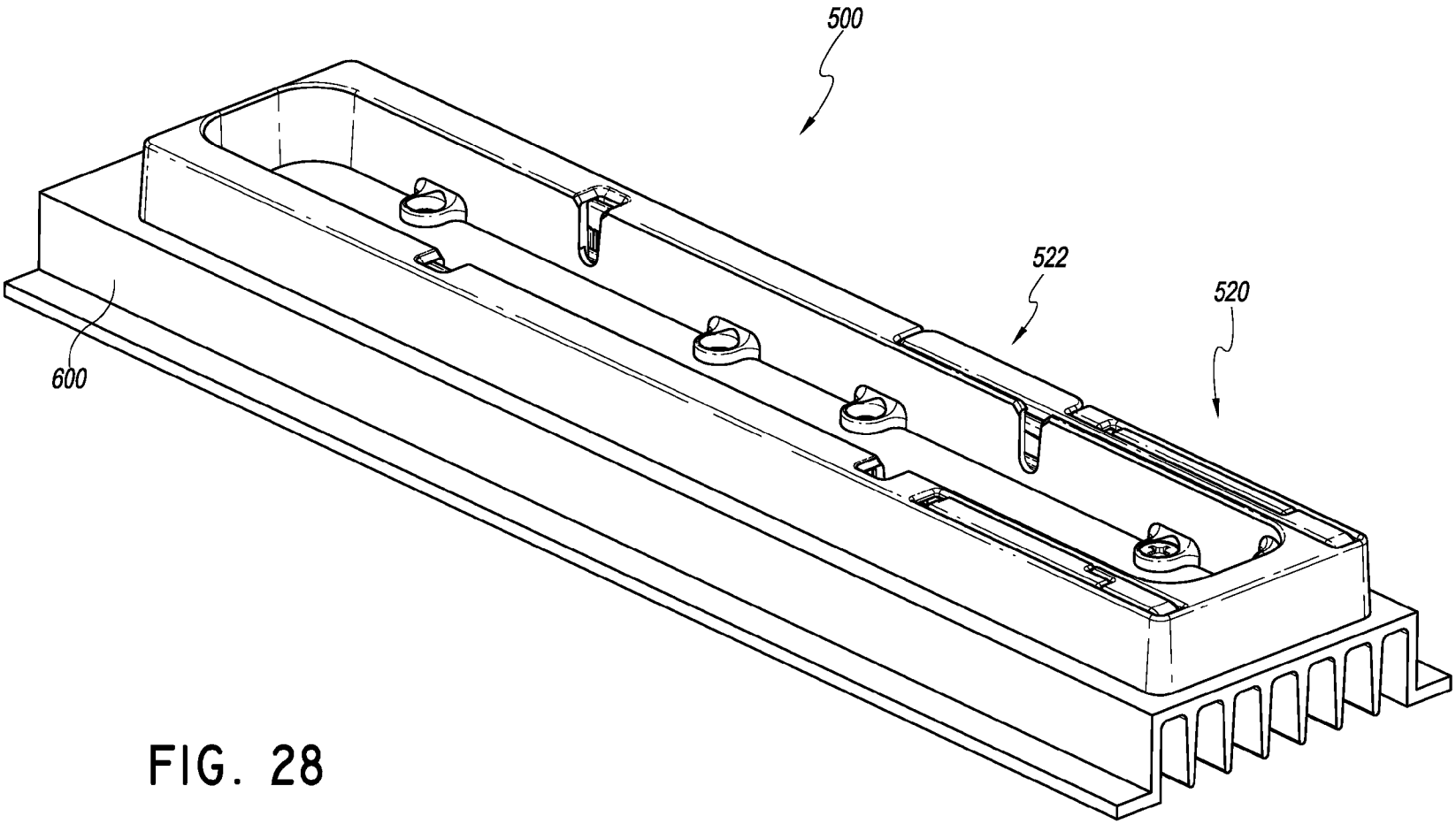
FIG. 28 is a top perspective view of the socket of FIG. 24 attached to the heat dissipating member, with the locking mechanism in a closed position.

FIGS. 26-28 show the socket 500 attached to the heat sink 600, with the linear light module 400 removed. The socket 500 has an opening 502 into which the linear light module 400 can be inserted. The socket 500 has one or more pin slots or openings 504 on an upper surface 502*a* thereof which can be sized to receive the one or more pins 404 on the light module body 402. Once in the openings 502, the locking mechanism 520 can be actuated to lock the pins 404, and thereby the linear light module 400, in the socket 500, as further described below. The socket 500 can have one or more fastener receivers 506 that can receive one or more fasteners therethrough to couple the socket 500 to the heat sink 600. The one or more openings or recesses 416 on the bottom 402*d* of the linear light module 400 can be sized to receive the one or more fastener receivers 506 therein when the module body 402 is installed in the socket 500, so that the bottom surface 412 of the module body 402 contacts a surface 620 of the heat sink 600 (e.g., to allow transfer of heat from the linear light module 400 to the heat sink 600 via contact of the surfaces 412, 620).

FIGS. 26-28 show the lever 522 and thereby the locking mechanism 520 in different operating positions. In FIG. 26, the lever 522 is in the open or unlocked position, which allows the openings 504 to receive the pins 404 of the module body 402. FIG. 27 shows the lever 522 in an intermediate position between the open and closed positions. In said intermediate position, the openings 504 are blocked by a member or portion of the locking mechanism 520, as further described below. Therefore, the pins 404 of the module body 402, and thereby the linear light module 400, could not be removed from the socket 500 once the lever 522 is in the intermediate position. FIG. 28 shows the lever 522 in the closed or locked position, where the locking mechanism 520 is fully engaged. Again, as can be seen, the openings 504 in the socket 500 are blocked by a member or portion of the locking mechanism 520. As described in more detail below, the locking mechanism 520 is actuated to lock the pins 404 in each of the openings 504 in the socket 500.

FIGS. 29-34 show the locking mechanism 520 components, as well as the locking mechanism in different operational positions. The lever 522 can have a lower member 522*a* pivotally coupled to an axle member 521, and to a push member 523*a* disposed on one side 508*a* of the socket 500. The axle member 521 can extend to an opposite side 508*b* of the socket 500 and connect to a link member 522*b*, which can be pivotally connected to a push member 523*b* disposed on said opposite side 508*b* of the socket 500. The push members 523*a*, 523*b* can interconnect with proximal slider members 524*a*, 524*b*, respectively, which can in turn interconnect with distal slider members 526*a*, 526*b*, respectively, via connectors 525*a*, 525*b*. Springs 527*a*, 527*b* can be disposed between distal ends of the distal link members 526*a*, 526*b*, respectively, and stop portions 528*a*, 528*b* of the socket 500. The link members 524*a*, 524*b*, 526*a*, 526*b* can each have a latch member 524*c*, 524*d*, 526*c*, 526*d*, respectively. Each latch member 524*c*, 524*d*, 526*c*, 526*d* can have an opening O that aligns with an opening 504 in the socket 500 that receives a pin 404 of the module body 402 when the lever 522 is in the open or unlocked position (see FIGS. 26, 30). Each latch member 524*c*, 524*d*, 526*c*, 526*d* can also have a locking member Y that defines a space Z into which the pin 404 moves as the locking mechanism 520 is moved to the closed position, where the locking member Y blocks the corresponding opening 504 in the socket when the lever 522 is moved toward the closed position.

In use, as the user moves the lever 522 from the open or unlocked position to the closed or locked position, the rotation of the lever 522 causes the push member 523*a* to move downward and forward (e.g., distally), which in turn causes the proximal slider member 524*a* to slide forward, which causes the distal slider member 526*a* to slide forward (via the connector 525*a*), compressing the spring 527*a* between the distal slider member 526*a* and the stop portion 528*a*. In another embodiment, the lever 522 can be directly connected to the slider member 524*a*, excluding the push member 523*a*. The axle member 521 is rotated by the movement of the lever 522, so that the link member 522*b* moves generally in unison with the lever 522 via the axle member 521. Accordingly, movement of the lever 522 toward the closed or locked position also causes the link member 522*b* to rotate downward, which causes the push member 523*b* to move downward and forward, which in turn causes the proximal slider member 524*b* to slide forward, which causes the distal slider member 526*b* to slide forward (via the connector 525*b*), compressing the spring 527*b* between the distal slider member 526*b* and the stop portion 528*b*. As the slider members 524*a*, 524*b*, 526*a*, 526*b* slide forward or distally, the locking member Y slides over the pin 404 to lock the pin 404, and thereby the module body 402 to the socket 500. To remove the module body 402 from the socket 500, the user can actuate the lever 522 to move it from the closed or locked position to the open or unlocked position, which causes the slider members 524*a*, 524*b*, 526*a*, 526*b* to slide proximally allowing the openings O of the latch members 524*c*, 524*d*, 526*c*, 526*d* to align with the openings 504 in the socket 500 so that the module body 402 can be withdrawn from the socket 500. As the lever 522 is moved from the closed or locked position, the springs 527*a*, 527*b* exert a force on the slider members 524*a*, 524*b*, 526*c*, 526*b* urging them toward the proximal end of the socket 500, thereby facilitating movement of the slider members 524*a*, 524*b*, 526*a*, 526*b* toward the unlocked position. In the unlocked position, the openings O of the latch members 524*c*, 524*d*, 526*c*, 526*d* are aligned with the openings 504 in the socket 500, and the pins 404 of the module body 402 can be removed from the latch members 524*c*, 524*d*, 526*c*, 526*d* and the module body 402 withdrawn from the socket 500.

Figure 29:
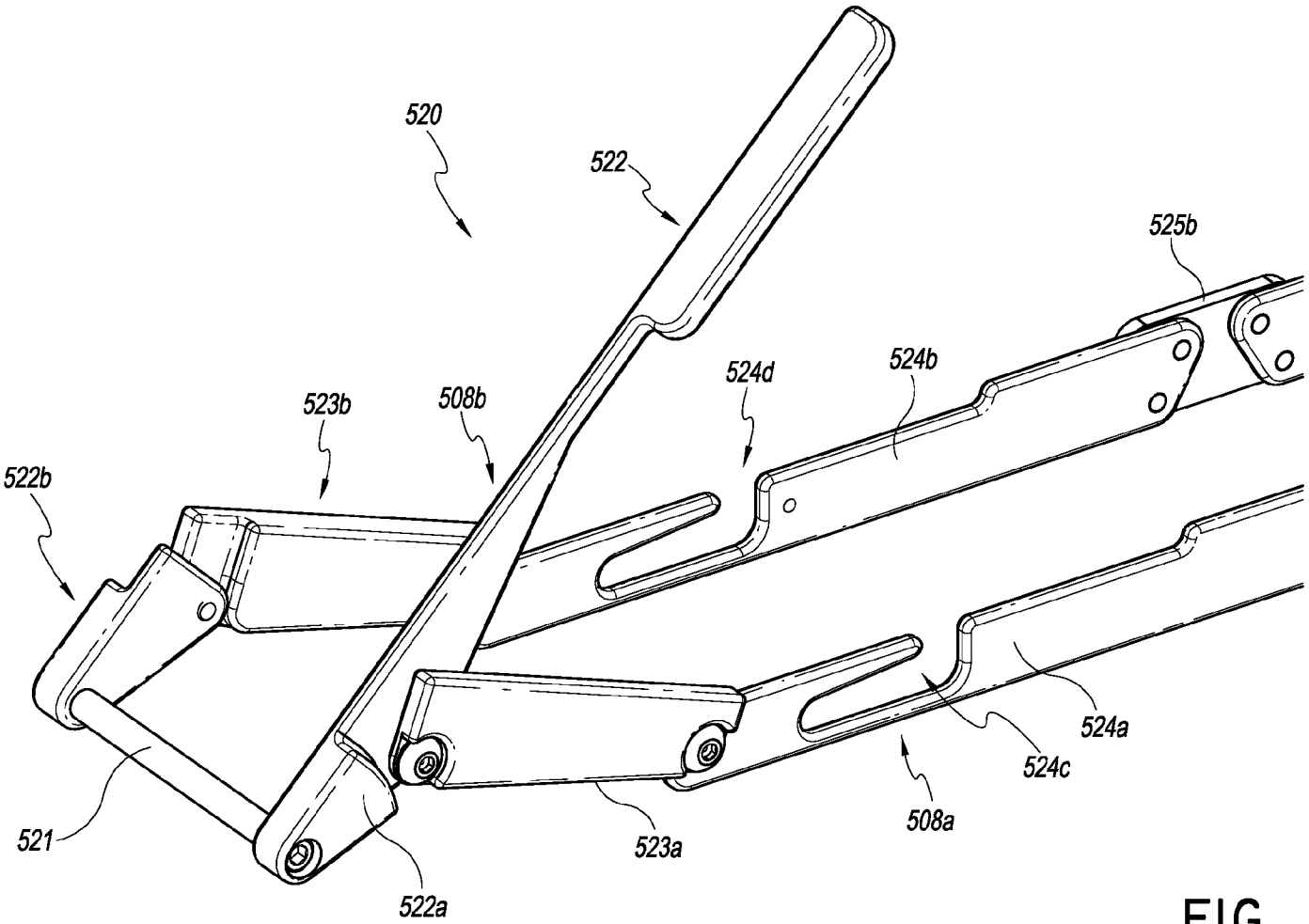
FIG. 29 is a partial cross-sectional view of the socket of FIG. 24 showing the locking mechanism of the socket of FIG. 24, with the body of the socket shown in phantom to illustrate the locking mechanism.
Figure 30:
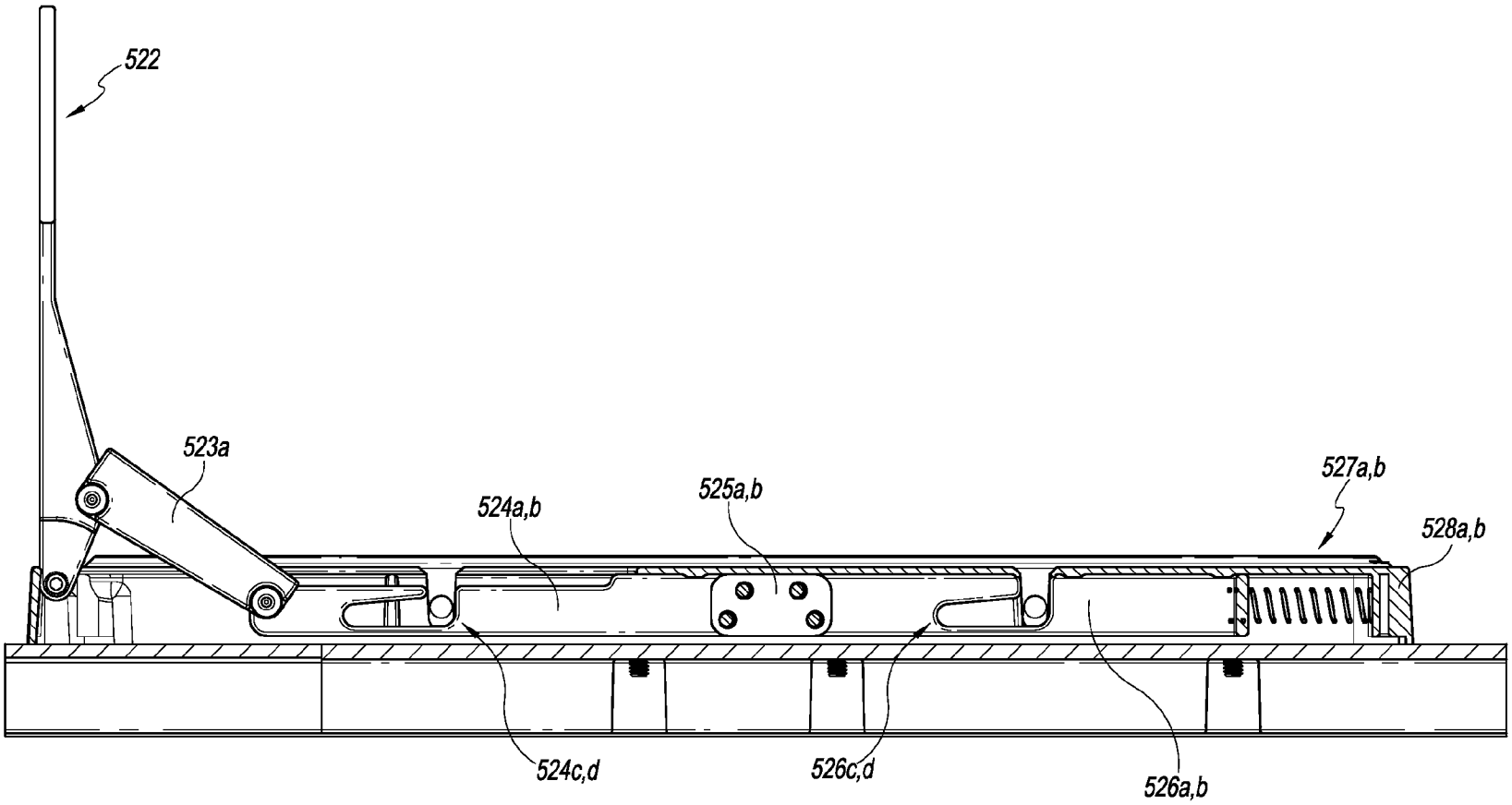
FIG. 30 is a cross-sectional longitudinal view of the linear light module installed in the socket of FIG. 24, with the locking mechanism in the fully open position.
Figure 33:
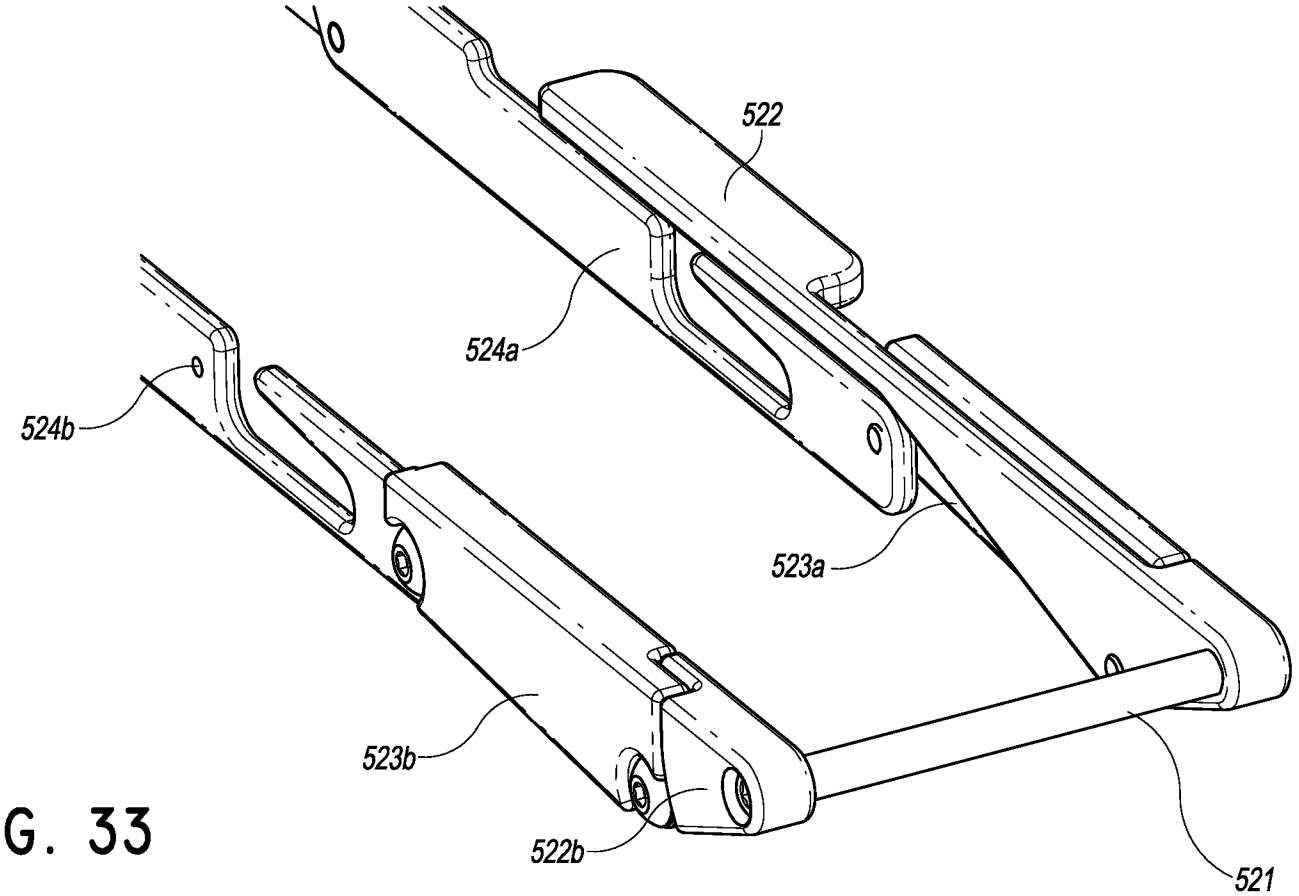
FIG. 33 is a partial cross-sectional view of the socket of FIG. 24 showing the locking mechanism of the socket in the closed position, with the body of the socket shown in phantom to illustrate the locking mechanism.
Figure 34:
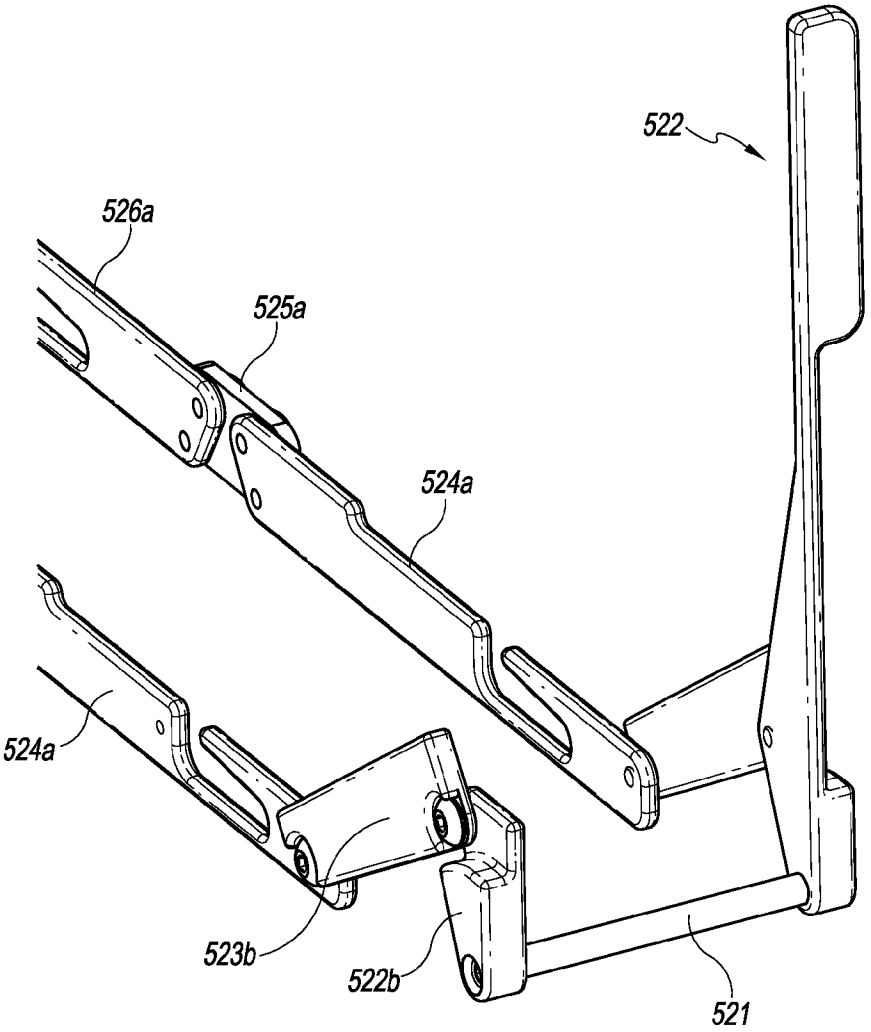
FIG. 34 is a partial cross-sectional view of the socket of FIG. 24 showing the locking mechanism of the socket in the open position, with the body of the socket shown in phantom to illustrate the locking mechanism.

As shown in FIGS. 29, 33 and 34, the slider members 524*a*, 524*b*, 526*a*, 526*b*, connectors 525*a*, 525*b*, axle member 521 an springs 527*a*, 527*b* can be disposed in the body of the socket 500 (e.g., within recesses or openings in the walls of the socket 500).

Figure 31:
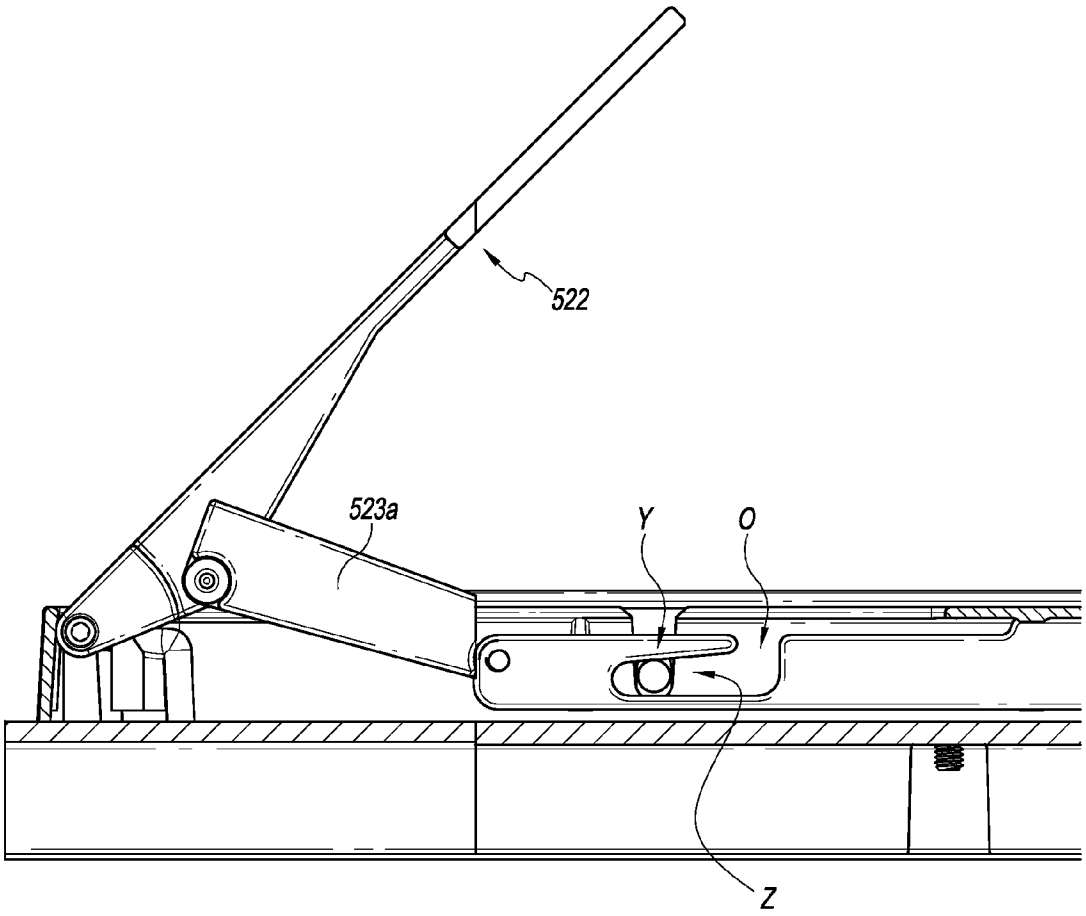
FIG. 31 is a partial cross-sectional longitudinal view of the linear light module installed in the socket of FIG. 24, with the locking mechanism in an intermediate position.
Figure 32:
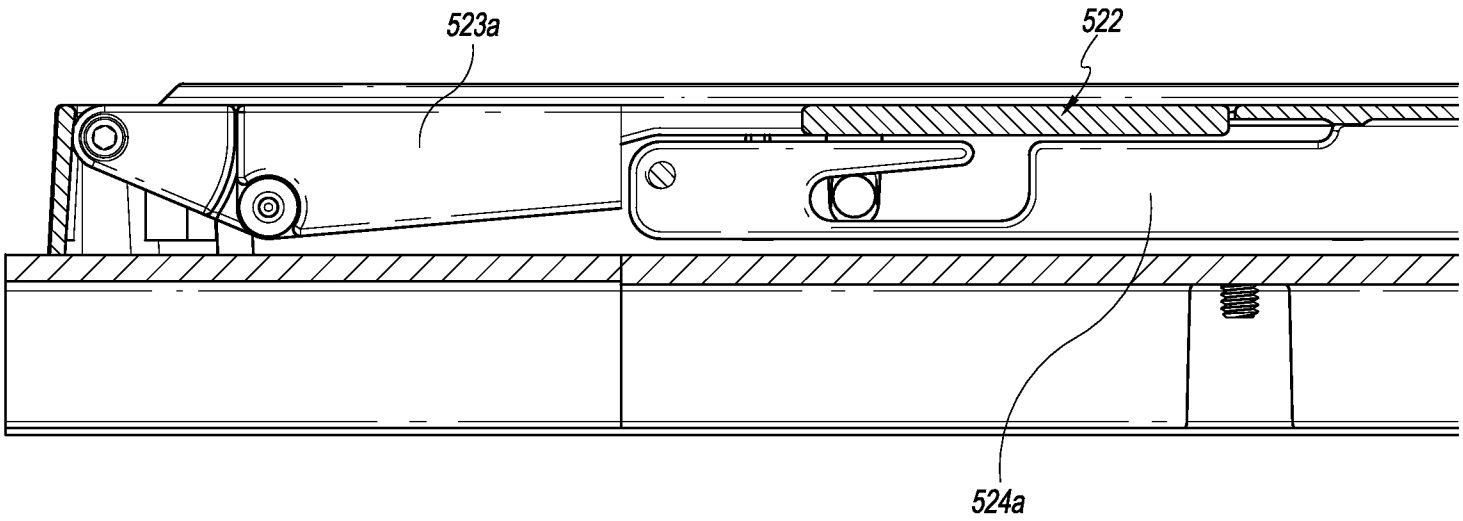
FIG. 32 is a partial cross-sectional longitudinal view of the linear light module installed in the socket of FIG. 24, with the locking mechanism in the closed position.
Figure 35:
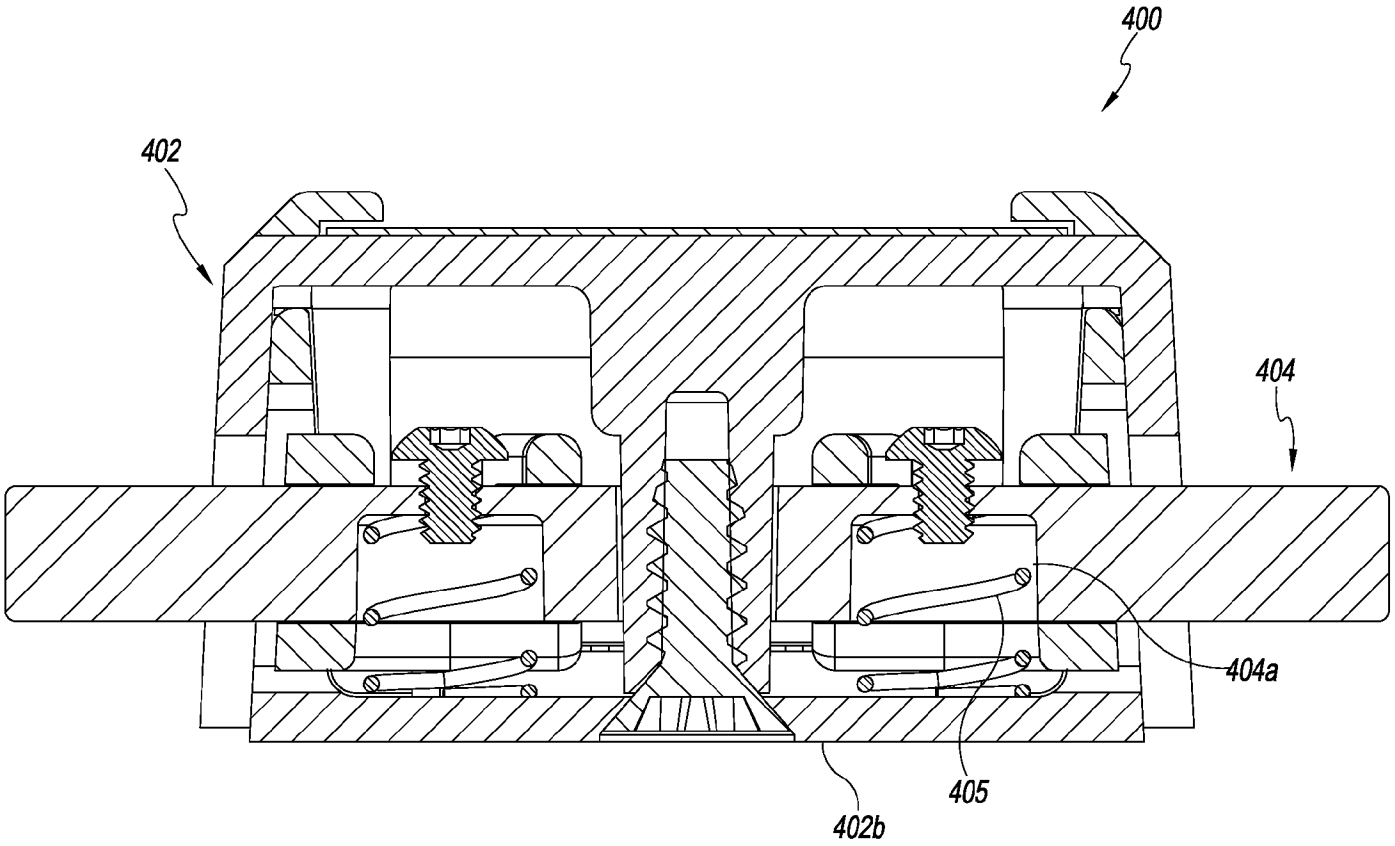
FIG. 35 is a transverse cross-sectional view of the linear light module of FIG. 22 along line 35-35.

FIG. 35 shows a cross-section of the linear light module 400. In the illustrated embodiment, each of the pins 404 has a recessed portion 404*a* into which a spring 405 extends, where the spring 405 is disposed between a portion of the pin 404 and a bottom portion 402*b* of the module body 402, such that the one or more pins 404 are spring loaded within the module body 402 relative to the bottom portion 402*b*. Advantageously, the locking members Y can have an inclined surface (as shown in FIG. 31), so that each locking member Y pushes downward on the pin 404, which in turn pushes downward on the bottom portion 402*b* via the spring 405 to provide resilient contact between the bottom portion 402*b* of the linear light module 400 and the surface 620 of the heat sink 600 so that heat can be transferred from the linear light module 400 to the heat sink 600. Although FIG. 35 shows the pins 404 in the linear module being spring-loaded, the springs could be elsewhere between the socket 500 and the light module body 402 or can be located in multiple locations between the socket 500 and the light module body 402.

In the illustrated embodiment, the pins 404 of the linear light module 400 can also serve as electrical contact members that engage electrical contact elements in the socket 500, which are provided by the slider members 524*a*, 524*b*, 526*a*, 526*b*. In another embodiment, the linear light module 400 and the socket 500 can have an electrical contact member and electrical contact element similar to that described above in connection with FIGS. 1-9. In yet another embodiment, the electrical connection between the linear light module 400 and the socket 500 can be made via other suitable mechanisms, such as electrical connectors, flying lead wires, etc.

Figure 36:
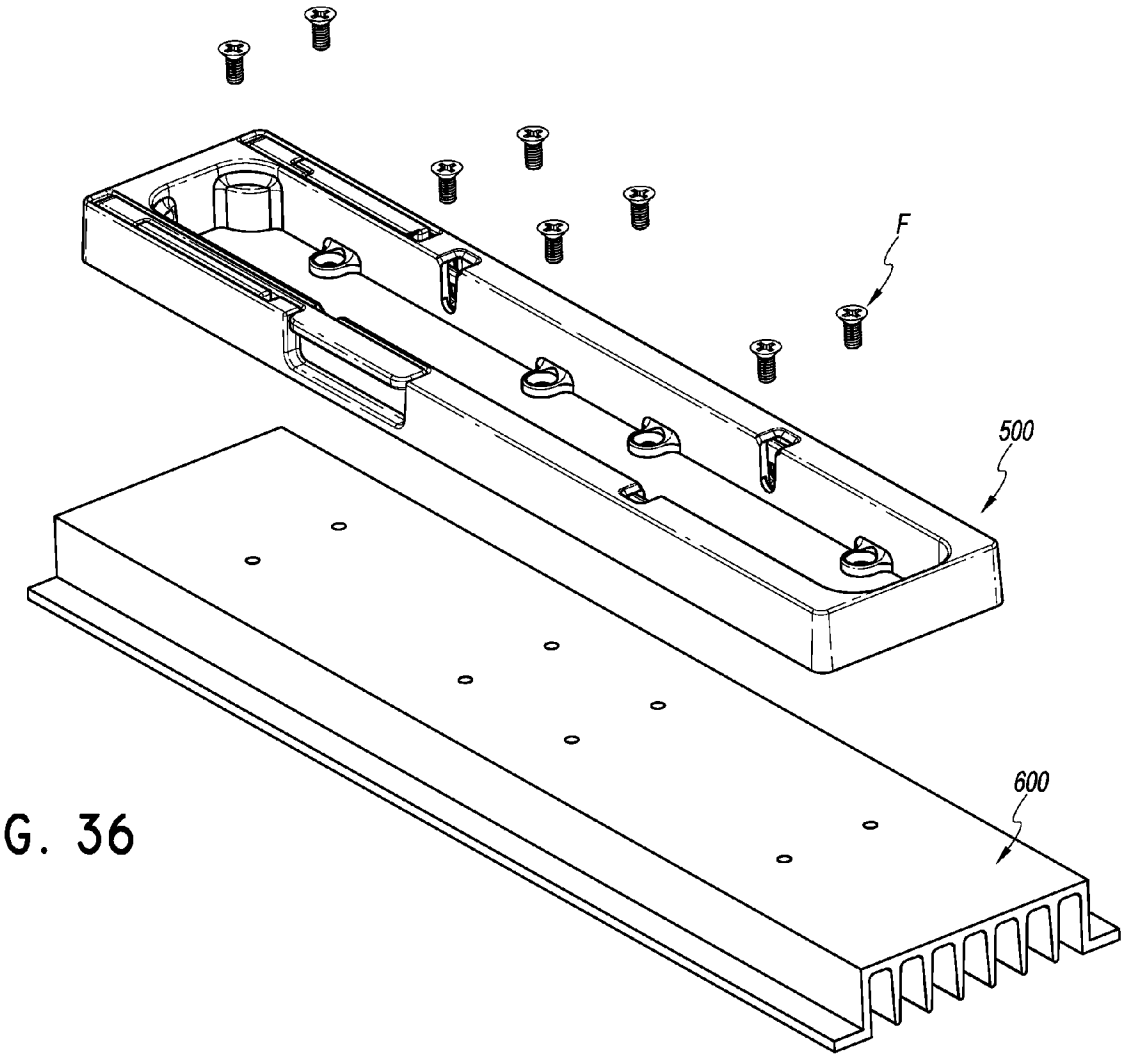
FIG. 36 is a top perspective exploded view of the socket of FIG. 24 and heat sink.
Figure 37:
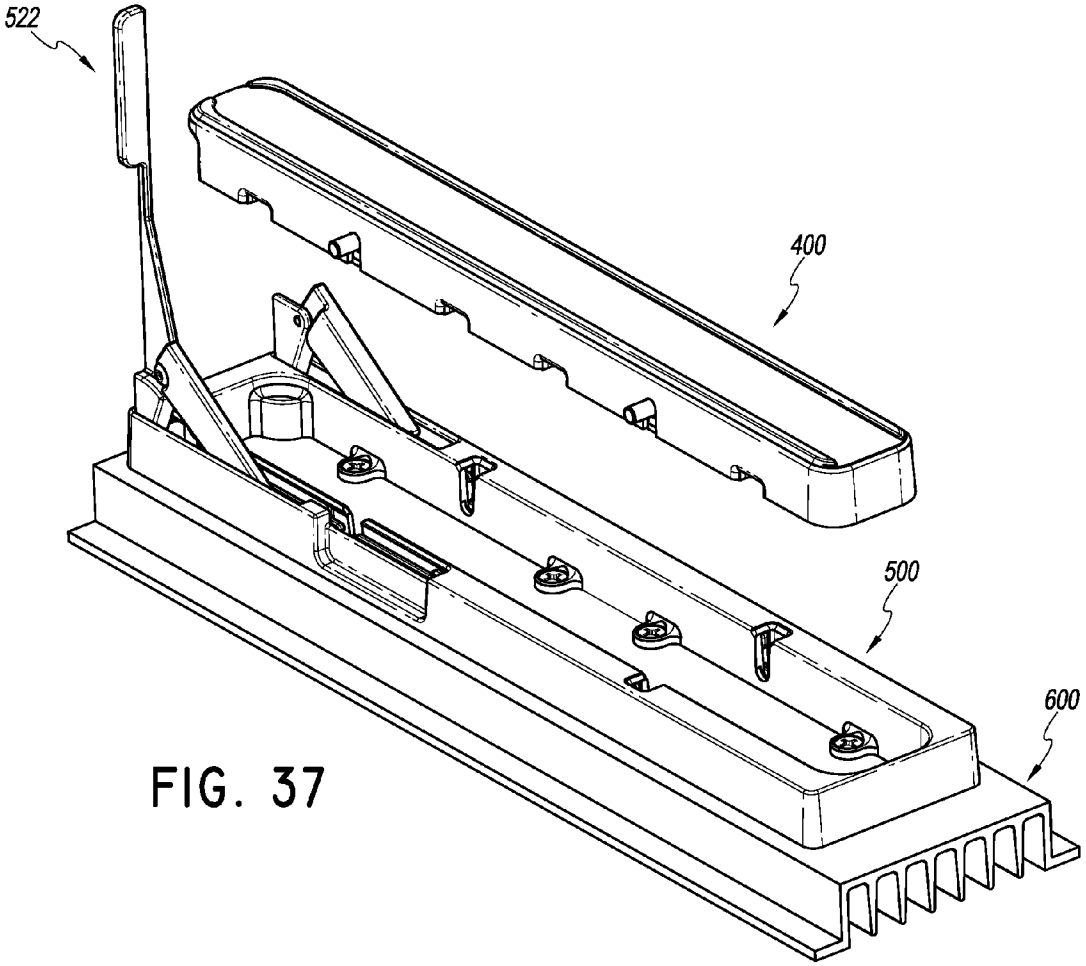
FIG. 37 is a top perspective view of the socket of FIG. 24 attached to the heat sink of FIG. 35, with the linear light module removed from the socket and the locking mechanism in the open position.

FIG. 36 shows an exploded view of the socket 500 and heat sink 600, with fasteners F that can fasten the socket 500 to the heat sink 600 via the fastener receivers 506. FIG. 37 shows the linear light module 400 removed from the socket 500, where the lever 522 is in the open or unlocked position.

Figure 38:
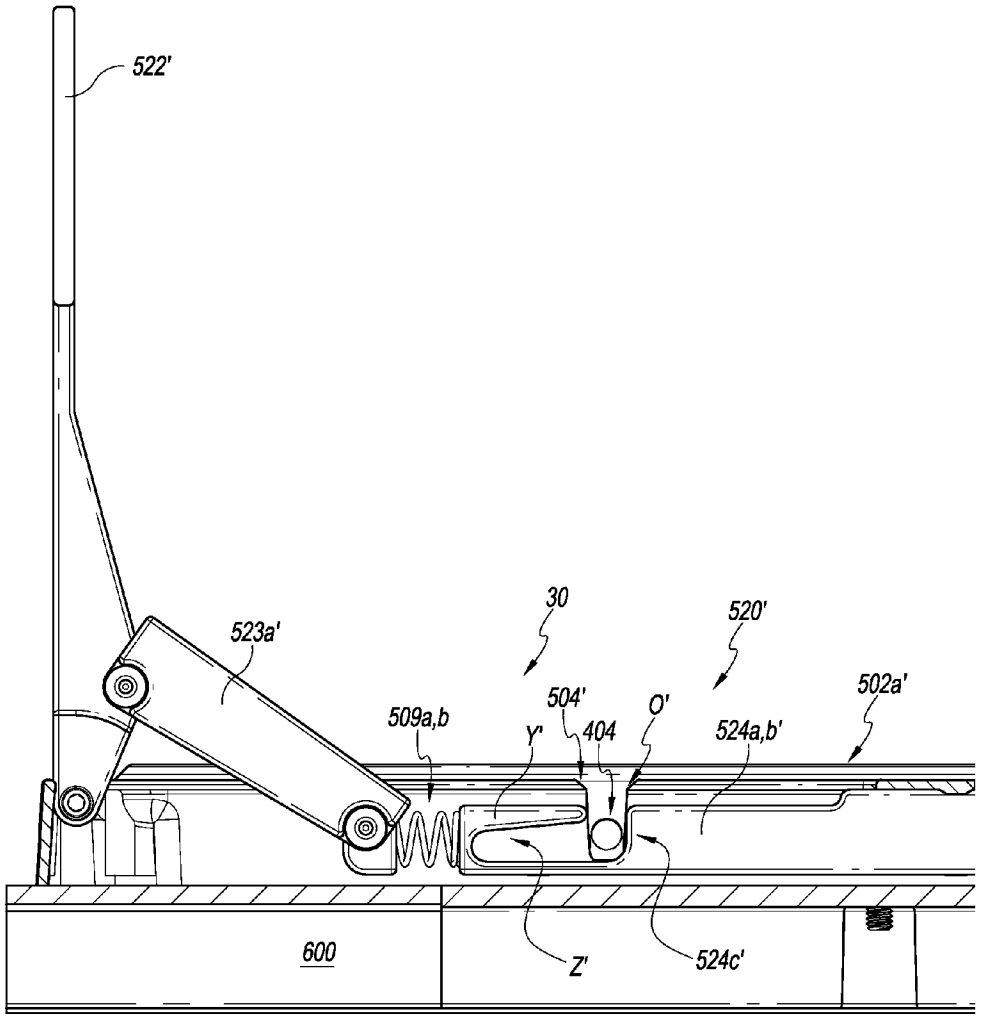
FIG. 38 is a partial cross-sectional longitudinal view of the linear light module of FIGS. 21-23 installed in another embodiment of a socket, with the locking mechanism in the fully open position.
Figure 39:
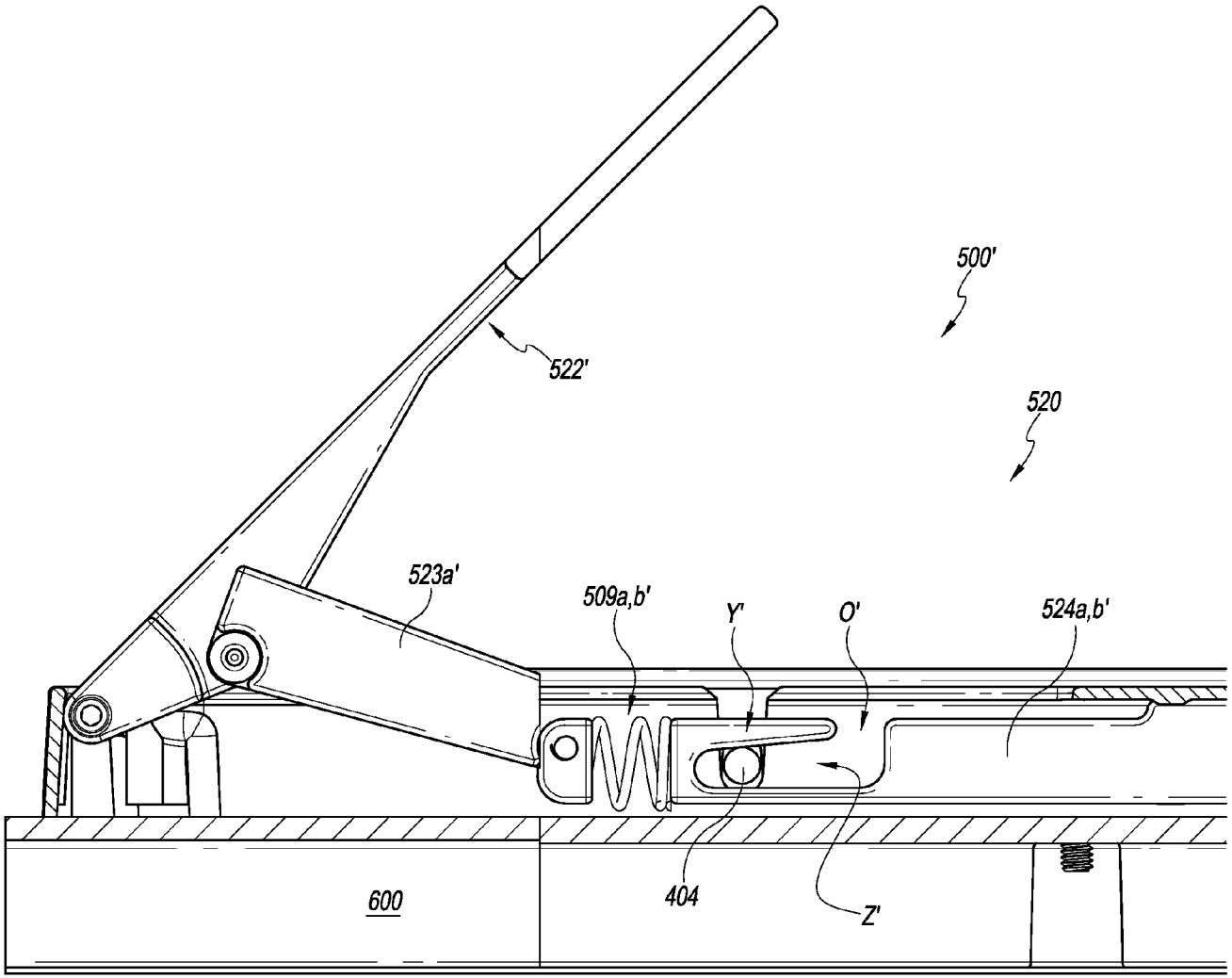
FIG. 39 is a partial cross-sectional longitudinal view of the linear light module installed in the socket of FIG. 38, with the locking mechanism in an intermediate position.
Figure 40:
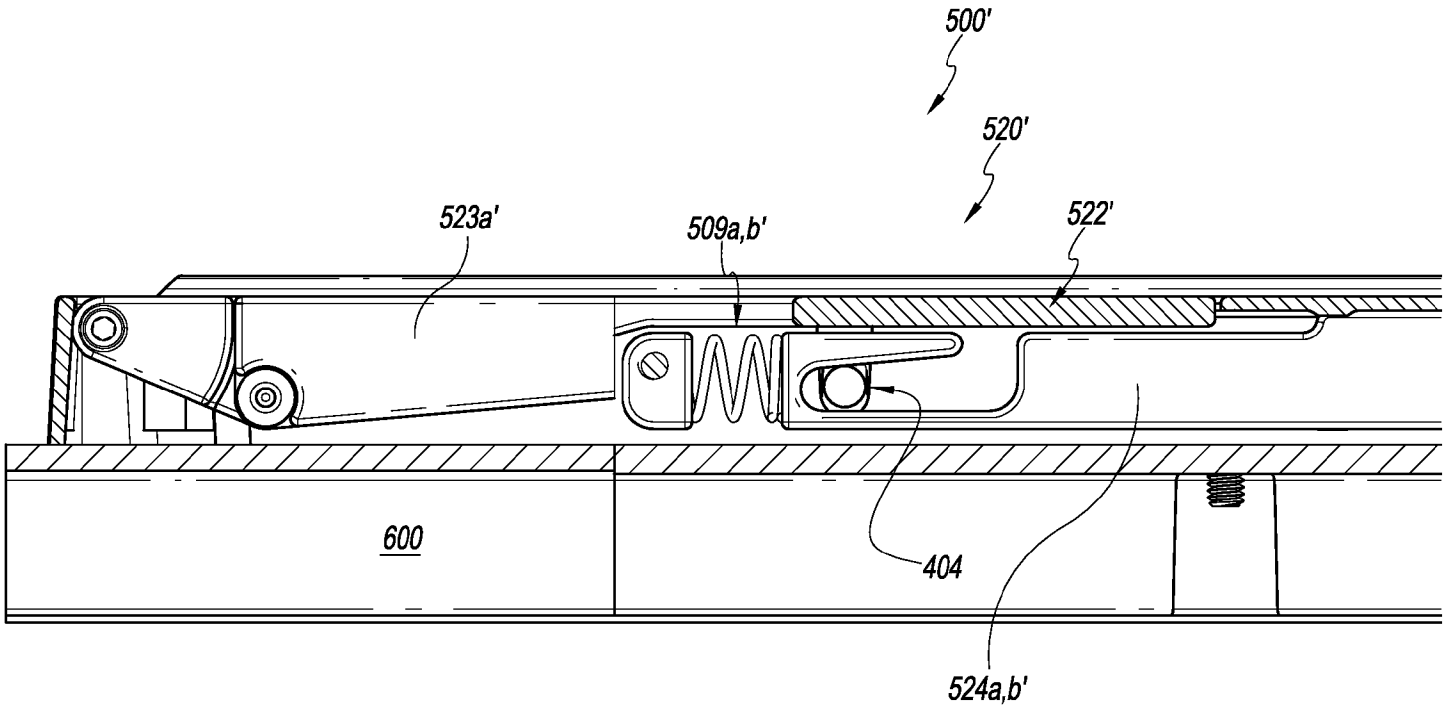
FIG. 40 is a partial cross-sectional longitudinal view of the linear light module installed in the socket of FIG. 38, with the locking mechanism in the closed position.

FIGS. 38-40 show the linear light module 400 installed in another embodiment of a socket 500'. The socket 500' is identical to the socket 500, respectively, except as noted below. Thus, the reference numerals used to designate the various components of the socket 500' are identical to those used for identifying the corresponding components of the socket 500 in FIGS. 24-34, except that a "'" has been added to the reference numerals.

In the illustrated embodiment, the locking mechanism 520' of the socket 500' can have a spring 509*a* disposed between the proximal slider member 524*a'* and the push member 523*a'*, and can have a spring 509*b* disposed between the proximal slider member 524*b'* and the push member 523*b'* on the opposite side of the socket 500'. All other components of the socket 500' and locking mechanism 520' can be similar to the components of the locking mechanism 520 and socket 500 in FIGS. 24-34. FIG. 38 shows the lever 522' in the open or unlocked position so that the opening O' of the latch member 524*c*' is aligned with the opening 504' in the socket 500', and so that the module body 402 can be disposed in the socket 500' such that the pins 404 extend into the space Z' in the latch member 524*c*'. FIG. 39 shows the lever 522' in an intermediate position, where the locking member Y' of the latch member 524*c*' extends below the opening 504', so that the pin 404 is prevented from withdrawal from the space Z' in the latch member 524*c*'. FIG. 40 shows the lever 522' in the closed or locked position, such that the lever 522' is generally flush with a top surface 502*a*' of the socket 500'.

In the illustrated embodiment, the springs 509*a*, 509*b* advantageously apply a force on the proximal slide members 524*a*', 524*b*' so that the proximal slide members 524*a*', 524*b*' (and therefore also the distal slide members 526*a*', 526*b*') are spring loaded relative to the lever 522'. This allows the springs 509*a*, 509*b* to exert a resilient force on the proximal slide members 524*a*', 524*b*' (and also distal slide members 526*a*', 526*b*') to resiliently lock the pins 404 within the latch members 524*c*', 524*d*' (and also 526*c*', 526*d*').

Although all of the embodiments described in the above specification describe the heat dissipating member as a heat sink 300, 600, the heat dissipating member can take many different form factors. As an example, the heat dissipating member could be the light fixture itself, or a portion of the light fixture, or can be an active cooling system (e.g. fan, SynJet® cooler or other active cooling systems). In another embodiment, the heat dissipating member can be a part of the socket, or the socket itself can dissipate heat when coupled to the linear light module. In the embodiment described above, when the module body 100, 100A, 100B, 100C, 100D, 400 is installed into the socket (e.g., socket 200, 200A, 200B, 200B', 200C, 200D, 500), a thermal connection or thermal coupling can be formed between at least a surface of the module body and at least a surface of the socket or the light fixture or heat dissipating member (e.g. heat sink, active cooling, etc.). Though not shown in FIGS. 38-40, the linear light module 400 can have an electrical contact element that contacts an electrical contact member of the socket 500 in a manner similar to that described above in connection with FIGS. 1-9, or can make its electrical connection through other suitable mechanisms, such as through the pins 404, flying lead wires with an electrical connector, etc.

In the embodiments described in the above specification, springs or resilient members are used to create a compression force to, for example, effect and/or maintain resilient contact between a surface of the linear light module and a thermally conductive surface (e.g., of the heat dissipating member, such as the heat sink 300, 600) in order to allow transfer of heat from the linear light module to the heat dissipating member. However, the compression force can be achieved through other suitable mechanisms, such as the deflection or bending of certain elements within the socket or the light module body, or through leaf springs, coil springs, rubber, compressible material (e.g. Poron® pads), etc.

Of course, the foregoing description is that of certain features, aspects and advantages of the present invention, to which various changes and modifications can be made without departing from the spirit and scope of the present invention. Moreover, the linear light module and socket need not feature all of the objects, advantages, features and aspects discussed above. Thus, for example, those skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of the specific features and aspects between and among the different embodiments may be made and still fall within the scope of the invention. Accordingly, it should be understood that various features and aspects of the disclosed embodiments can be combined with or substituted for one another in order to form varying modes of the discussed linear light module and socket.

What is claimed is:

1. A lighting assembly, comprising:

a linear light module comprising one or more LED light elements, a length of the light module being greater than a width of the light module the linear light module having one or more locking members on side surfaces thereof, wherein the side surfaces face in a direction perpendicular to a longitudinal axis of the linear light module; and an elongate socket removably coupleable to a heat dissipating member, the elongate socket having a socket body that defines a peripheral opening configured to removably receive the linear light module therein so that the side surfaces of the linear light module face inner side surfaces of the socket body when the linear light module is installed in the elongate socket, the elongate socket comprising a locking mechanism housed in one or more side walls of the socket body and having one or more locking elements that align with the one or more locking members of the linear light module when the linear light module is installed in the elongate socket, the locking mechanism manually actuatable by a user via one or more levers movably coupled to the socket body so that the one or more locking elements releasably and resiliently couple to the one or more locking members to lock the linear light module in the socket.

2. The assembly of claim 1, further comprising a heat dissipating member coupleable to the socket such that a thermally conductive surface of the linear light module resiliently contacts a thermally conductive surface of the heat dissipating member to allow heat flow from the linear light module to the heat dissipating member.

3. The assembly of claim 1, wherein the one or more locking members of the linear light module comprise one or more pins that extend from said side surfaces thereof, the socket having one or more openings on a top surface thereof configured to receive the one or more pins therein.

4. The assembly of claim 3, wherein the one or more locking elements comprise one or more locks and wherein the one or more levers are configured to actuate the one or more locks to lockingly engage the one or more pins.

5. The assembly of claim 4, wherein each of the locks includes a ramp that bears against the pin as the lever is actuated in a fore-aft direction.

6. The assembly of claim 4, wherein the one or more locks comprise a pair of locks on opposite sides of the socket body and interconnected by an axle, said pair of locks actuated by a single lever.

7. The assembly of claim 1, wherein the one or more levers are configured to move between an open position where the locking mechanism is unlocked and a closed position where the locking mechanism is locked.

8. The assembly of claim 1, wherein the one or more levers comprises two levers, where each of the levers actuates at least one locking element to lock the linear light module to the socket.

9. The module of claim 1, wherein the one or more locking elements are spring loaded within the socket body.

10. A lighting assembly, comprising:

a linear light module comprising one or more LED light elements, a length of the light module being greater than a width of the light module;

an elongate socket removably coupleable to a heat dissipating member, the elongate socket having a socket body that defines a peripheral opening with a shape corresponding to the linear light module, the elongated socket configured to removably receive the linear light module therein such that side surfaces of the linear light module face inner side surfaces of the socket body when the linear light module is installed in the elongate socket; and means for releasably locking the linear light module in the socket via actuation of one or more levers by a user, the one or more levers being movably coupled to a sidewall of the elongate socket and configured to move along said sidewall in a fore-aft direction parallel to a longitudinal axis of the elongate socket, said means at least partially housed in one or more sidewalls of the socket body.

11. The assembly of claim 10, further comprising a heat dissipating member coupleable to the socket such that a thermally conductive surface of the linear light module resiliently contacts a thermally conductive surface of the heat dissipating member to allow heat flow from the linear light module to the heat dissipating member.

12. The assembly of claim 11, wherein the one or more levers are configured to move between an open position and a closed position to unlock and lock the linear light module to the socket.

13. The assembly of claim 10, wherein the one or more levers comprises two levers.

* * * * *

UNITED STATES PATENT AND TRADEMARK OFFICE

CERTIFICATE OF CORRECTION

PATENT NO. : 8,876,322 B2
APPLICATION NO. : 13/867730
DATED : November 4, 2014
INVENTOR(S) : Clayton Alexander It is certified that error appears in the above-identified patent and that said Letters Patent is hereby corrected as shown below:

In the Specification,

At column 2, line 59, please delete “FIG. 1” and insert -- FIG. 1. --, therefor.

At column 10, line 5, please delete “102'''” and insert -- 102''' in --, therefor.

In the Claims,

At column 17, line 5, please delete “module” and insert -- assembly --, therefor.

Signed and Sealed this
Nineteenth Day of May, 2015

Michelle K. Lee

Michelle K. Lee
*Director of the United States Patent and Trademark Office*